United States Patent [19]

Deguchi et al.

[11] Patent Number: 4,886,738

[45] Date of Patent: Dec. 12, 1989

[54] SILVER HALIDE COLOR PHOTOGRAPHIC MATERIAL

[75] Inventors: Naoyasu Deguchi; Sadao Kamei; Kensuke Goda; Sadanobu Shuto; Yasuhiro Hayashi, all of Kanagawa, Japan

[73] Assignee: Fuji Photo Film Co., Ltd., Kanagawa, Japan

[21] Appl. No.: 104,130

[22] Filed: Oct. 5, 1987

[30] Foreign Application Priority Data

Oct. 3, 1986 [JP] Japan ..... 61-235764

[51] Int. Cl.[4] ..... G03C 1/84; G03C 1/06

[52] U.S. Cl. ..... 430/510; 430/564; 430/611; 430/613; 430/614

[58] Field of Search ..... 430/564, 379, 611, 510, 430/613, 614

[56] References Cited

U.S. PATENT DOCUMENTS 4,082,553 6/1978 Groet .
4,508,816 10/1985 Yamamuro et al. .
4,626,498 12/1986 Shuto et al. ..... 430/379
4,788,132 11/1988 Deguchi et al. ..... 430/505

FOREIGN PATENT DOCUMENTS

191948A2 4/1986 European Pat. Off. .

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A silver halide color photographic material comprising a support having thereon at least one silver halide photographic emulsion layer and at least one layer containing colloidal silver, wherein said colloidal silver-containing layer comprises at least one compound selected from compounds of general formula (I) and (II) below, and at least one photosensitive or non-photosensitive layer selected from a silver halide photosensitive layer positioned farthest from said support and any layers positioned between said farthest photosensitive layer and said support comprises a silver halide emulsion containing internally-fogged or surface-fogged silver halide grains:

(I)

(II)

wherein the substituent groups on general formula (I) and (II) are as defined in the specification.

16 Claims, No Drawings

SILVER HALIDE COLOR PHOTOGRAPHIC MATERIAL

FIELD OF THE INVENTION

This invention relates to a color photographic material and, more particularly, to a color reversal photographic material having improved push developability.

BACKGROUND OF THE INVENTION

Color photographic materials usually comprise a support and at least two silver halide emulsion layers having different color sensitivities (the term "color sensitivity" as used herein denotes the property of being sensitive to three wavelength regions of the spectrum of visible light, namely, any of red, green and blue light wavelengths) formed thereon.

In the field of color photographic materials, particularly color reversal photographic materials often utilized in practice by professional photographers, color photographic materials having high sensitivity are required in order to photograph certain scenes, for example, for photographing sporting events which requires fast shutter speeds, or photographing stage scenes in which the quantity of light required for exposure is often insufficient. Few color photographic materials are available which meet the above requirements. Under these circumstances, the sensitivity of the color photographic materials can be adjusted by treating the material in order to compensate for insufficient exposure. This adjustment of sensitivity by treatment is usually called "push development", and in the case of color reversal photographic materials, it is carried out by prolonging the time of the first development step (black-and-white development) beyond the time normally employed for standard processing.

However, conventional color reversal photographic materials do not always have sufficient push developability, and thus have one or more of the following defects:

(1) sensitization is not adequately effected unless the time of the first development step is prolonged well beyond the time required for standard processing;

(2) in a photographic material comprising a relatively high sensitive layer and a relatively low sensitive layer separated from each other, the push development may cause a change in gradation because these layers have different developability.

(3) an attempt to increase the degree of sensitization by prolonging the first development time results in a drastic decrease in the maximum density of the resulting colored images; and (4) at the time of the push development, the color balance is degraded because of the differences in the developability among a red-sensitive layer, a green-sensitive layer and a blud-sensitive layer.

U.S. Pat. Nos. 2,996,382 and 3,178,282 describe a negative image-forming photographic element having an increased speed and contrast as a result of including both silver halide grains capable of forming a surface latent image when exposed, and silver halide grains containing an internal fog nucleus. The specificationsof these U.S. patents, however, fail to describe the push development, and also fail to disclose an ordinary color reversal photographic material. According to these types of photographic element, silver halide grains having a surface latent image release a reaction product according to the amount of exposure upon development after exposure. This causes the formation of cracks in the silver halide grains having an internal fog nucleus, and also enables development. The speed and contrast increase also during standard development of such photographic materials, but the sensitization cannot be controlled by the push development.

Japanese patent application (OPI) No. 214852/84 (the term "OPI" as used herein refers to a "published unexamined Japanese patent application") discloses a method of improving push developability by incorporating a silver halide emulsion having a fog nucleus in the interior of the silver halide grains into a photosensitive emulsion layer and/or a layer adjacent to it.

Investigations in connection with the development of the present invention, however, showed that when a color reversal photographic material included a silver halide emulsion containing a fog nucleus inside the silver halide grains in a photosensitive emulsion layer and/or a layer adjacent to it, sensitization of the lower density portion becomes greater than sensitization of the higher density portion at the time of push development. Also, the entire gradation during push development becomes undesirably hard.

It has been desired, therefore, to develop a color reversal photographic material in which at the time of push development, the sensitivity is desirably increased, the reduction of maximum density is small, and variations in gradation are also desirably small.

SUMMARY OF THE INVENTION

It is an object of this invention to provide a color photographic material, particularly, a color reversal photographic material, wherein at the time of push development, the sensitivity is desirably increased, the reduction of maximum density is small, and variations in gradation are small.

The above and other objects of the present invention are accomplished by a silver halide color photographic material comprising a support having thereon at least one silver halide photographic emulsion layer and at least one layer containing colloidal silver, wherein the colloidal silver-containing layer comprises at least one compound selected from compounds of general formulae (I) and (II) below, and at least one photosensitive or nonphotosensitive layer selected from a silver halide photosensitive layer positioned farthest from the support and any layers positioned between the farthest photosensitive layer and the support comprises a silver halide emulsion containing internally-fogged or surface-fogged silver halide grains:

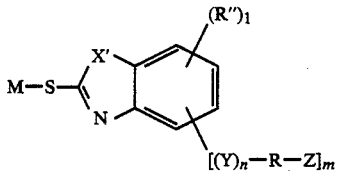

(I)

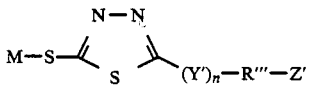

(II)

wherein in general formula (I), R represents a linear or branched alkylene group, a linear or branched alkenylene group, a linear or branched aralkylene group, or an arylene group;

Z represents a polar substituent;

Y represents $$-S-,\ -O-,\ -\overset{R_1}{\overset{|}{N}}-,\ -\overset{O}{\overset{\|}{C}}-\overset{R_2}{\overset{|}{N}}-,\ -\overset{R_3}{\overset{|}{N}}-\overset{O}{\overset{\|}{C}}-,\ -SO_2\overset{R_4}{\overset{|}{N}}-,$$

$$-\overset{R_5}{\overset{|}{N}}SO_2-,\ -\overset{O}{\overset{\|}{C}}O-,\ -O\overset{O}{\overset{\|}{C}}-,\ -\overset{O}{\overset{\|}{C}}-,\ -\overset{R_6}{\overset{|}{N}}-\overset{O}{\overset{\|}{C}}-\overset{R_7}{\overset{|}{N}}-,$$

$$-\overset{R_8}{\overset{|}{N}}-\overset{S}{\overset{\|}{C}}-\overset{R_9}{\overset{|}{N}}-,\ \text{or}\ -\overset{R_{10}}{\overset{|}{N}}-\overset{O}{\overset{\|}{C}}-O-,$$

in which each of $R_1$, $R_2$, $R_3$, $R_4$, $R_5$, $R_6$, $R_7$, $R_8$, $R_9$ and $R_{10}$, which may be the same or different (e.g., in the case of $R_6$ and $R_7$ or $R_8$ and $R_9$), represents a hydrogen atom or a substituted or unsubstituted alkyl group, a substituted or unsubstituted aryl group, a substituted or unsubstituted alkenyl group or a substituted or unsubstituted aralkyl group;

X' represents $$-O-,\ -\overset{R'}{\overset{|}{N}}-\text{or}\ -S-,$$

in which R' represents a hydrogen atom or a substituted or unsubstituted alkyl group or a substituted or unsubstituted alkenyl group;

R'' represents a hydrogen atom or a group capable of replacing it;

M represents a hydrogen atom, an alkali metal atom, an ammoniumyl group or a group capable of being split off under alkaline conditions;

n represents 0 or 1;

m represents 0, 1 or 2, provided that m is not 0 when ' is —S—; and l represents (4—m); and in general formula (II), R''' represents a linear or branched alkylene group, a linear or branched alkenylene group, a linear or branched aralkylene group or an arylene group;

Z' represents a hydrogen atom or a polar substituent;

Y' represents $$-S-,\ -\overset{R_{11}}{\overset{|}{N}}-,\ -\overset{R_{12}}{\overset{|}{N}}-\overset{O}{\overset{\|}{C}}-\overset{R_{13}}{\overset{|}{N}}-,$$

$$-\overset{R_{14}}{\overset{|}{N}}-\overset{S}{\overset{\|}{C}}-\overset{R_{15}}{\overset{|}{N}}-,\ -\overset{R_{16}}{\overset{|}{N}}-\overset{O}{\overset{\|}{C}}-O-,\ -\overset{R_{17}}{\overset{|}{N}}-\overset{O}{\overset{\|}{C}}-,\ \text{or}\ -\overset{R_{18}}{\overset{|}{N}}-SO_2-,$$

in which each of $R_{11}$, $R_{12}$, $R_{13}$, $R_{14}$, $R_{15}$, $R_{16}$, $R_{17}$ and $R_{18}$, which may be the same or different (e.g., in the case of $R_{12}$ and $R_{13}$ or $R_{14}$ and $R_{15}$), represents a hydrogen atom, or a substituted or unsubstituted alkyl group, a substituted or unsubstituted aryl group, a substituted or unsubstituted alkenyl group or a substituted or unsubstituted aralkyl group; and n represents 0 or 1.

DETAILED DESCRIPTION OF THE INVENTION

In the present invention, a silver halide emulsion in which the interior or the surface of the silver halide grains is fogged is present in at least one layer selected from a silver halide photosensitive layer positioned farthest from the support and any layers positioned between that outermost photosensitive layer and the support. During development processing, the fogged silver halide emulsion is developed, and these developed silver halide grains then promote the development of the photosensitive silver halide emulsion to bring about a large increase in sensitivity, particularly during push development. However, in whichever layer among these mentioned above the fogged silver halide emulsion is incorporated, development of the low density portion tends to be promoted with the result that in the characteristic curve of push development, the resulting contrast is seen to be high.

The compounds represented by general formulae (I) and (II) in accordance with this invention are capable of being adsorbed not only onto silver halide, but also onto colloidal silver.

The adsorptive power of these compounds with respect to colloidal silver is weaker than that onto silver halide. Thus, during development, these compounds gradually separate from colloidal silver and diffuse into a photosensitive silver halide emulsion layer. Consequently, these compounds inhibit the development of the emulsion layer from a stage about halfway through development.

This development inhibiting effect is especially high on a low sensitivity emulsion (which contributes to the resulting gradation of the low density portion when developing a color reversal photographic material).

Such development inhibition takes place about halfway through the development step because it takes time for the compounds of general formulae (I) and (II) to gradually separate from colloidal silver during development and then to diffuse to a silver halide emulsion layer. This aspect of the present invention thus creates a significant difference, especially as to resulting photographic effects, from the case where the compounds of general formulae (I) and (II) are included in a photosensitive silver halide emulsion layer and thus inhibit development from its commencement.

It has been found in accordance with the present invention that by including at least one of the compounds of general formulae (I) and (II) in the colloidal silver-containing layer, and further providing a silver halide emulsion fogged in the interior or surface of the grains, that is, containing internally-fogged or surface-fogged silver halide grains, in at least one layer selected from a photosensitive silver halide emulsion layer farthest from the support and any layers positioned between that photosensitive layer and the support, a great rise in sensitivity can be achieved during push development with little variation in the resulting gradation. Preferably at least one photosensitive materials comprises a silver halide emulsion containing internally-fogged or surface-fogged silver halide grains.

The layer containing colloidal silver may be any layer positioned between the support and a photosensitive silver halide emulsion layer positioned farthest from the support, and, desirably, it is positioned between the support and a photosensitive silver halide emulsion layer positioned nearest from the support. Preferably the layer containing colloidal silver is an antihalation layer.

The silver halide emulsion fogged in the interior or the surface of the grains, as referred to herein, denotes a silver halide emulsion which can be developed uniformly (nonimagewise) whether in an unexposed area or an exposed area of a photographic material.

The silver halide emulsion fogged in the interior of the grains is an emulsion comprising coreshell type silver halide grains composed of an internal nucleus of surface-fogged silver halide grains and an outer shell of silver halide covering the surface of the internal nucleus. This type of emulsion is hardly developed during the initial stage of development, and in color reversal development in which push development is performed, at least about 30% of the total amount of silver in the silver halide grains are developed irrespective of whether or not the photographic material is exposed.

The surface-fogged silver halide emulsion can be prepared, for example, by a method comprising adding a reducing agent or a gold salt at a suitable pH and pAg to an emulsion capable of forming a surface latent image, a method comprising heating the aforesaid emulsion at a low pAg, or a method comprising subjecting the above emulsion to a uniform exposure. Stannic chloride, hydrazine type compounds, and ethanolamine, for example, may be used as the reducing agent.

The silver halide grains fogged in the interior of the grains may be prepared by depositing silver halide on the surface of the surface-fogged silver halide grains thus forming an outer shell.

Investigations by the present inventors have revealed the following facts.

The fogged silver halide emulsion is hardly developed in the initial stage of development, and is mainly developed during push development. Consequently, a reduction in maximum density during push development is small, and a great increase in sensitivity can be expected.

Hence, an emulsion comprising silver halide grains fogged in the interior of the grains is preferable to a surface-fogged emulsion.

By changing the thickness of the outer shell of the core-shell type silver halide grains fogged in the interior of the grains, the timing of the solution physical development can be adjusted to thereby control the extent of the increase in sensitivity due to the push development.

The preferred thickness of the outer shell varies with the type of development, development time, the timing of solution physical development, etc. Usually, the thickness is about 30 to 1,000 Å. In particular, good results can be obtained by setting it at 50 to 500 Å.

The silver halide forming the internal nucleus of the core-shell type silver halide grains fogged in the interior of the grains and the silver halide forming the outer shell may have the same or different halogen compositions.

The silver halide fogged in the interior or the surface of the grains may, for example, be any of silver chloride, silver chlorobromide, silver iodobromide, and silver chloroiodobromide.

There is no particular restriction on the particle size of the fogged silver halide grains. They may have an average particle size of about 0.01 to about 1.5 μm, preferably 0.05 to 1.0 μm.

Neither is there any restriction on the shape of the grains. The silver halide grains may be regular or irregular. They may be polydispersed emulsions, but are preferably monodispersed emulsions (wherein at least about 95% of the weight or number of silver halide grains have a particle diameter within ±40% of the average particle diameter).

The silver halide emulsion fogged in the interior or the surface of the grains is incorporated into at least one layer selected from a photosensitive silver halide layer positioned farthest from the support and any layers positioned between that photosensitive layer and the support. Preferably, the fogged emulsion is added to the photosensitive silver halide layer farther from the support.

When the photographic material contains two or more photosensitive layers having different photosensitivities but the same color sensitivity, the fogged silver halide emulsion may be included in any of them, but preferably it is added to layers other than a layer having the highest sensitivity.

The amount of the silver halide emulsion fogged in the interior or the surface of the grains in accordance with this invention varies with the development conditions, the timing of the solution physical development, etc. Preferably, it is about 0.05 to about 50 mol%, especially 0.1 to 40 mol%, based on photosensitive silver halide in the same layer or in an adjacent layer.

The colloidal silver-containing layer containing at least one of compounds of general fomrulae (I) and (II) is preferably an antihalation layer or a yellow filter layer.

The compounds of formulae (I) and (II) will be described below in further detail.

In general formula (I), R represents a linear or branched alkylene group, a linear or branched alkenylene group, a linear or branched aralkylene group or an arylene group; Z represents a polar substituent; Y represents

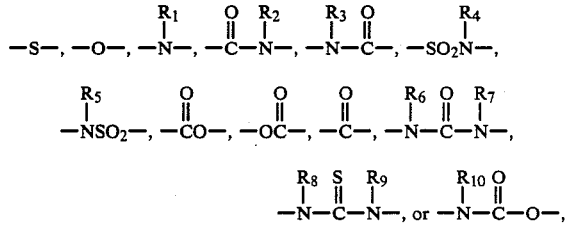

in which each of $R_1$, $R_2$, $R_3$, $R_4$, $R_5$, $R_6$, $R_7$, $R_8$, $R_9$ and $R_{10}$, which may be the same or different (e.g., in the case of $R_6$ and $R_7$ or $R_8$ and $R_9$), represents a hydrogen atom or a substituted or unsubstituted alkyl group, a substituted or unsubstituted aryl group, a substituted or unsubstituted alkenyl group or a substituted or unsubstituted aralkyl group; X' represents —O—,

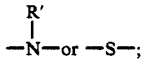

R' represents a hydrogen atom or a substituted or unsubstituted alkyl group or a substituted or unsubstituted alkenyl group; R'' represents a hydrogen atom or a group capable of replacing it; M represents a hydrogen atom, an alkali metal atom, an ammoniumyl group or a group capable of being split off under alkaline conditions; n represents 0 or 1; m represents 0, 1 or 2, with the proviso that when X' is —S—, m is not 0; and l represents (4−m).

More specifically, R represents a linear or branched alkylene group (such as a methylene group, an ethylene group, a propylene group, a butylene group, a hexylene group or a 1-methylethylene group); a linear or branched alkenylene group (such as a vinylene group or a 1-methylvinylene group); a linear or branched aralkylene group such as a benzylidene group; or an arylene group such as a phenylene group or a naphthylene group.

Examples of the polar substituent represented by Z are unsubstituted or substituted amino groups (including their salts) such as an amino group, a hydrochloride of an amino group, a methylamino group, a dimethylamino group, a hydrochloride of a dimethylamino group, a dibutylamino group, a dipropyl group and an N-dimethylaminoethyl-N-methylamino group; quaternary ammoniumyl groups such as a trimethyl ammoniumyl chloride group and a dimethylbenzyl ammoniumyl chloride group; alkoxy groups such as a methoxy group, an ethoxy group and a 2-hydroxyethoxy group; aryloxy groups such as a phenoxy group; alkylthio groups such as methylthio group and a butylthio group; arylthio groups such as a phenylthio group; heterocyclic oxy groups such as a 2-pyridyloxy group and a 2-imidazolyloxyl group; heterocyclic thio groups such as a 2-benzothiazolylthio group and a 4-pyrazolylthio group; a sulfonyl group such as a methanesulfonyl group, an ethanesulfonyl group and a p-toluenesulfonyl group; carbamoyl groups such as an unsubstituted carbamoyl group and a methylcarbamoyl group; sulfamoyl groups such as an unsubstituted sulfamoyl group and a methylsulfamoyl group; carbonamide groups such as an acetamide group and a benzamide group; sulfonamide groups such as a methanesulfonamide group and a benzenesulfonamide group; acyloxy groups such as an acetyloxy group or a benzoyloxy group; ureido groups such as an unsubstituted ureido group, a methylureido group and an ethylureido group; acyl groups such as an acetyl group and a benzoyl group; aryloxycarbonyl groups such as a phenoxycarbonyl group; thioureido groups such as an unsubstituted thioureido group and a methylthioureido ureido group; sulfonyloxy groups such as a methanesulfonyloxy group and a p-toluenesulfonyloxy group; heterocyclic groups such as a 1-morpholino group, a 1-piperidino group, a 2-pyridyl group, a 4-pyridyl group, a 2-thienyl group, a 1-pyrazolyl group, a 1-imidazolyl group, a 2-imidazolyl group, a 2-tetrahydrofuryl group and a 2-tetrahydrothienyl group; and a hydroxyl group.

Each of $R_1$, $R_2$, $R_3$, $R_4$, $R_5$, $R_6$, $R_7$, $R_8$, $R_9$ and $R_{10}$ represents a hydrogen atom, a substituted or unsubstituted alkyl group such as a methyl group, an ethyl group, a propyl group or a 2-dimethylaminoethyl group, a substituted or unsubstituted aryl group such as a phenyl group or a 2-methylphenyl group, a substituted or unsubstituted alkenyl group such as a propenyl group or a 1-methylvinyl group, or a substituted or unsubstituted aralkyl group such as a benzyl group or a phenethyl group.

R′ represents a hydrogen atom, a substituted or unsubstituted alkyl group such as a methyl group, an ethyl group, a propyl group, a 2-dimethylaminoethyl group, a 2-hydroxyethyl group, a 2-imidazolylethyl group or a 2-dimethylaminopropyl group, or a substituted or unsubstituted alkenyl group such as a propenyl group or a 1-methylvinyl group.

R″ represents a hydrogen atom or a group capable of replacing it. Examples of the group capable of replacing the hydrogen atom include halogen atoms such as a fluorine atom, a chlorine atom or a bromine atom; substituted or unsubstituted alkyl groups having 1 to 6 carbon atoms such as a methyl group, a trifluoromethyl group, an ethyl group or an n-butyl group; substituted or unsubstituted aryl groups having 6 to 12 carbon atoms such as a phenyl group or a 4-methylphenyl group; substituted or unsubstituted alkoxy groups having 1 to 6 carbon atoms such as a methoxy group or an ethoxy group; substituted or unsubstituted aryloxy groups having 6 to 12 carbon atoms such as a phenoxy group or a 4-methylphenyl group; sulfonyl groups having 1 to 12 carbon atoms such as a methanesulfonyl group or a p-toluenesulfonyl group; sulfonamide groups having 1 to 12 carbon atoms such as a methanesulfonamide group, a p-toluenesulfonamide group or an ethanesulfonamide group; sulfamoyl groups having 1 to 12 carbon atoms such as a diethylsulfamoyl group or a phenylsulfamoyl group; carbamoyl groups having 1 to 12 carbon atoms such as a carbamoyl group, a methylcarbamoyl group or a phenylcarbamoyl group; amide groups having 2 to 12 carbon atoms such as an acetamide group or a benzamide group; ureido groups having 1 to 12 carbon atoms such as a ureido group, a 3-methylureido group or a 3-phenylureido group; aryloxycarbonyl or alkoxycarbonyl groups having 2 to 12 carbon atoms such as a methoxycarbonyl group or a phenoxycarbonyl group; aryloxycarbonylamino or alkoxycarbonylamino groups having 2 to 12 carbon atoms such as a methoxycarbonylamino group or a phenoxycarbonylamino group; and a cyano group.

M represents a hydrogen atom, an alkali metal atom such as a sodium atom or a potassium atom, an ammoniumyl group such as a trimethyl ammoniumyl chloride group or a dimethylbenzyl ammoniumyl chloride group, or a group capable of being split off from the sulfur atom and replaced with a hydrogen atom or an alkali metal under alkaline conditions (such as an acetyl group, a cyanoethyl group or a methanesulfonylethyl group). Preferably, M is a hydrogen atom, an alkali metal atom or an ammoniumyl group.

Preferred substituents for compounds of general formula (I) include those wherein R represents a substituted or unsubstituted alkylene group; Y represents

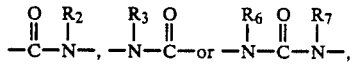

in which $R_2$, $R_3$, $R_6$ and $R_7$ are hydrogen atoms; X′ is —NH— or —O—; and Z represents a substituted or unsubstituted amino group, a salt thereof or a heterocyclic group. Particularly preferred X′ is —NH—.

Specific examples of compounds of general formula (I) are given below; however, the present invention is not to be construed as being limited thereto:

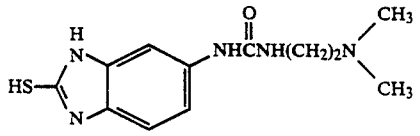

(I-1)

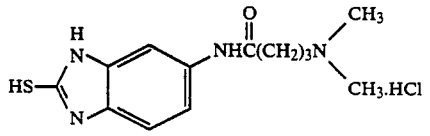

(I-2)

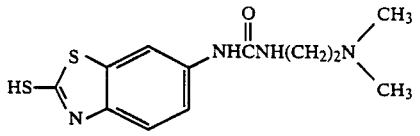

(I-3)

-continued
(I-4)
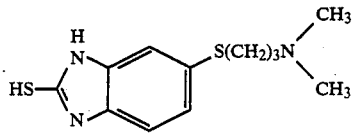
(I-5)
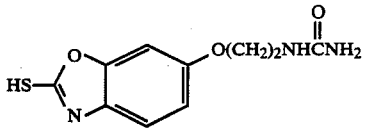
(I-6)
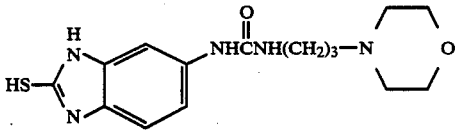
(I-7)
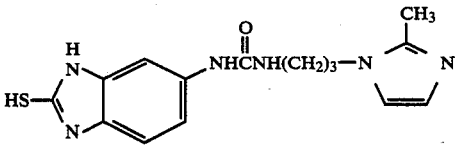
(I-8)
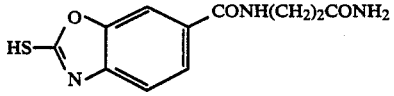
(I-9)
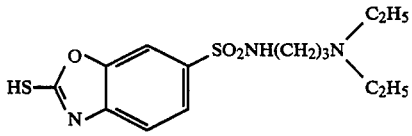
(I-10)
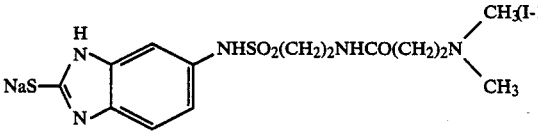
(I-11)
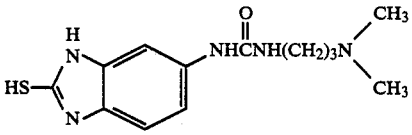
(I-12)
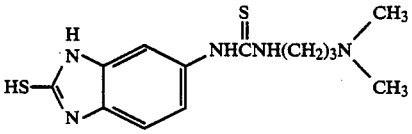
(I-13)
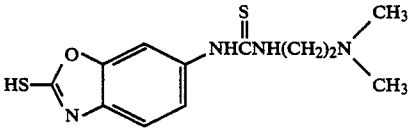
(I-14)
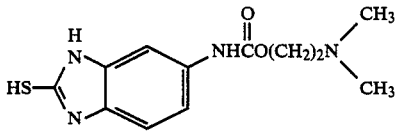
-continued
(I-15)
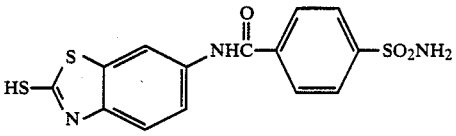
(I-16)
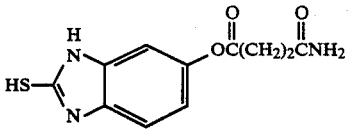
(I-17)
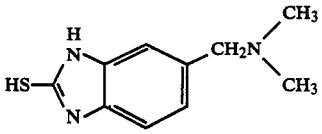
(I-18)
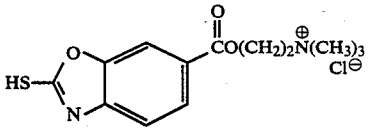
(I-19)
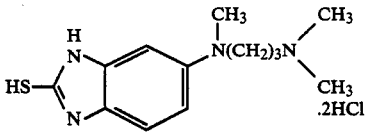
(I-20)
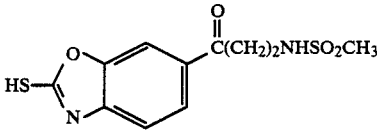
(I-21)
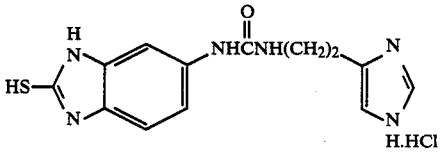
(I-22)
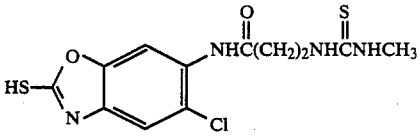
(I-23)
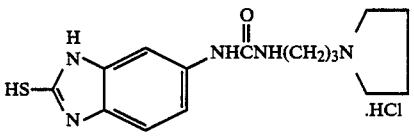
(I-24)
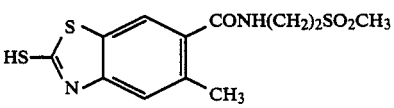
(I-25)
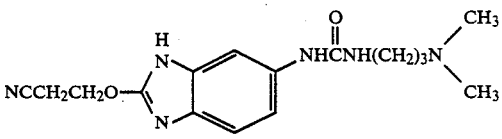

-continued (I-26)

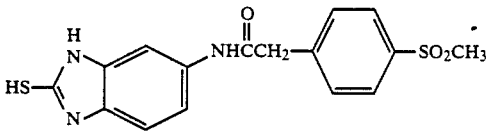

(I-27)

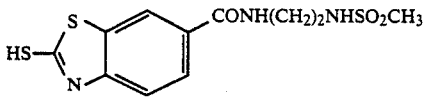

(I-28)

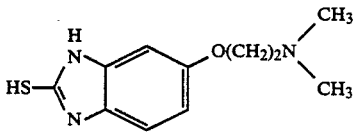

(I-29)

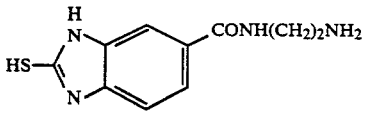

(I-30)

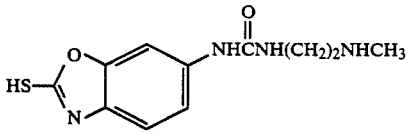

(I-31)

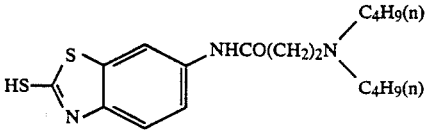

(I-32)

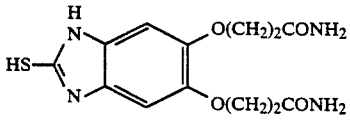

(I-33)

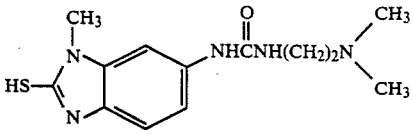

(I-34)

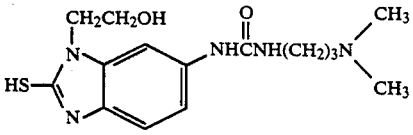

(I-35)

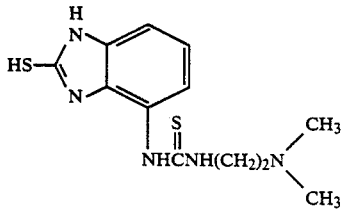

(I-36)

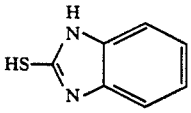

-continued (I-37)

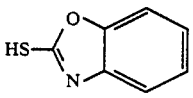

(I-38)

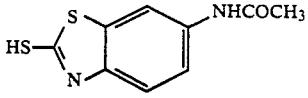

(I-39)

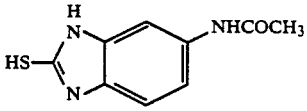

(I-40)

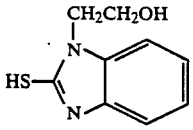

The compounds of general formula (I) used in this invention may be synthesized by the methods described in *Organic Synthesis*, IV, 569 (1963), *Journal of the American Chemical Society*, 45, 2390 (1923) and *Chemische Berichte*, 9, 465 (1876), which are incorporated herein by reference, and the following typical synthesis examples.

SYNTHESIS EXAMPLE 1

Method of Synthesis of Compound (I-1)

N,N-dimethylacetamide (250 ml) was added to 36.6 g of 5-amino-2-mercaptobenzimidazole and 17.1 ml of pyridine, and 34.4 g of phenyl chloroformate was added dropwise at room temperature. The mixture was stirred at room temperature for 1.5 hours, and 1.5 liters of ice water was added. As a result, crystals precipitated. The resulting crystals were collected by filtration and recrystallized from acetonitrile to give 47.7 g of 2-mercapto-5-phenoxycarbonylaminobenzimidazole.

Acetonitrile (100 ml) was added to 8.6 g of the resulting 2-mercapto-5-phenoxycarbonylaminobenzoylimidazole, and the mixture was heated at 45° C. with stirring. N,N-dimethylaminoethylenediamine (14.5 g) was added dropwise, and the mixture was stirred at 45° C. for 1.5 hours. The precipitated crystals were collected by filtration, and recrystallized from a mixture of N,N-dimethylformamide and methanol to give 6.2 g (yield: 74%) of the desired compound. Melting Point: 240° C. (decomp.).

SYNTHESIS EXAMPLE 2

Method of Synthesis of Compound (I-11)

Ethanol (100 ml) was added to 14.3 g of the 2-mercapto-5-phenoxycarbonylaminobenzimidazole obtained in Synthesis Example 1, and 3-N,N-dimethylaminopropylamine was added dropwise at room temperature. After this addition, the mixture was stirred at 40° C. for 2 hours. On addition of 100 ml of acetonitrile, crystals precipitated. The precipitated crystals were collected by filtration and recrystallized twice from a mixture of N,N-dimethylformamide and acetonitrile to give 7.2 g (yield: 49%) of the desired compound. Melting Point: more than 280° C. (decomp.).

SYNTHESIS EXAMPLE 3

Method of Synthesis of Compound (I-6)

Ethanol (100 ml) was added to 14.3 g of the 2-mercapto-5-phenoxycarbonylaminobenzimidazole obtained in Synthesis Example 1, and 8.7 g of 3-morpholinopropylamine was added dropwise at room temperature. After this addition, the mixture was stirred at 50° C. for 30 minutes, and then cooled to room temperature whereupon crystals precipitated. The crystals were collected by filtration and recrystallized from a mixture of N,N-dimethylformamide and acetonitrile to give 6.7 g (yield: 42%) of the desired compound. Melting Point: more than 280° C. (decomp.).

SYNTHESIS EXAMPLE 4

Method of Synthesis of Compound (I-27)

N,N-dimethylformamide (80 ml) was added to 12.6 g of 6-carboxy-2-mercaptobenzothiazole, and 12.6 ml of triethylamine was added dropwise under ice cooling. Furthermore, 8.6 ml of ethyl chloroformate was added. The mixture was stirred for 30 minutes under ice cooling, and 9.7 g of 2-methanesulfonamidoethylamine was added dropwise. The mixture was stirred for 4 hours. 1 liter of ice water was added to the reaction solution, and the precipitated crystals were collected by filtration. Recrystallization from ethanol gave 12.1 g (yield: 61%) of the desired compound. Melting Point: 242°–244° C.

SYNTHESIS EXAMPLE 5

Method of Synthesis of Compound (I-28)

To 120 ml of an ethanol solution of 2.4 g of potassium hydroxide was added 7.8 g of p-(2-N,N-dimethylaminoethoxy)-o-phenylenediamine, and 12 ml of carbon disulfide was added dropwise at 40° C. After the addition, the mixture was heated under reflux for 5 hours, and 6 ml of concentrated hydrochloric acid was added. The solvent was evaporated under reduced pressure and the resulting oily residue was purified on a silica gel column, and then recrystallized from acetonitrile to give 3.8 g (yield: 40%) of the desired compound. Melting Point: 233°–235° C. (decomp.).

SYNTHESIS EXAMPLE 6

Method of Synthesis of Compound (I-13)

Ethanol was added to 17.2 g of 2-mercapto-6-phenoxycarbonylaminobenzoxazole synthesized as in Synthesis Example 1, and 6.2 g of N,N-dimethylethylenediamine was added dropwise at room temperature. After this addition, the mixture was stirred at 50° C. for 30 minutes, and then cooled to room temperature, whereupon crystals precipitated. The crystals were collected by filtration and recrystallized from a mixture of N,N-dimethylformamide and acetonitrile to give 13.3 g (yield: 79%) of the desired compound. Melting Point: higher than 280° C. (decomp.).

In general formula (II), R''' represents a linear or branched alkylene group, a linear or branched alkenylene group, a linear or branched aralkylene group or an arylene group; Z' represents a hydrogen atom or a polar substituent; Y' represents —S—,

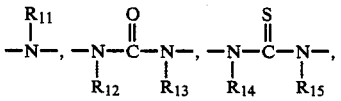

-continued

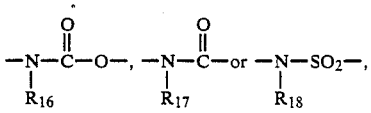

in which $R_{11}$, $R_{12}$, $R_{13}$, $R_{14}$, $R_{15}$, $R_{16}$, $R_{17}$ or $R_{18}$, which may be the same or different (e.g., in the case of $R_{12}$ and $R_{13}$ or $R_{14}$ and $R_{15}$), represents a hydrogen atom, or a substituted or unsubstituted alkyl group, a substituted or unsubstituted aryl group, a substituted or unsubstituted alkenyl group or a substituted or unsubstituted aralkyl group; M represents a hydrogen atom, an alkali metal atom, an ammoniumyl group, or a group capable of being split off under alkaline conditions; and n is 0 or 1.

More specifically, R''' represents a linear or branched alkylene group such as a methylene group, an ethylene group, a propylene group, a butylene group, a hexylene group or a 1-methylethylene group, a linear or branched alkenylene group such as a vinylene group or a 1-methylvinylene group, a linear or branched aralkylene group such as a benzylidene group, or an arylene group such as a phenylene group or a naphthylene group.

Examples of the polar substituent represented by Z' include substituted or unsubstituted amino groups (including salts thereof) such as an amino group, a hydrochloride of an amino group, a methylamino group, a dimethylamino group, a hydrochloride of a dimethylamino group, a dibutylamino group, a dipropylamino group or an N-dimethylaminoethyl-N-methylamino group; quaternary ammoniumyl groups such as a trimethyl ammoniumyl chloride group or a dimethylbenzyl ammoniumyl chloride group, an alkoxy group such as a methoxy group, an ethoxy group or a 2-methoxyethoxy group; aryloxy groups such as a phenoxy group; alkylthio groups such as a methylthio group or a butylthio group; arylthio groups such as a phenylthio group; heterocyclic oxy groups such as a 2-pyridyloxy group or a 2-imidazolyloxy group; heterocyclic thio groups such as a 2-benzothiazolylthio group or a 4-pyrazolylthio group; sulfonyl groups such as a methanesulfonyl group, an ethanesulfonyl group or a p-toluenesulfonyl group; carbamoyl groups such as a carbamoyl group or a methylcarbamoyl group; sulfamoyl groups such as a sulfamoyl group or a methylsulfamoyl group; carbonamide groups such as an acetamide group or a benzamide group; sulfonamide groups such as a methanesulfonamide group or a benzenesulfonamide group; acyloxy groups such as an acetyloxy group or a benzoyloxy group; ureido groups such as a ureido group, a methylureido group or an ethylureido group; acyl groups such as an acetyl group or a benzoyl group; aryloxycarbonyl groups such as a phenoxycarbonyl group; thioureido groups such as a thioureido group or a methylthioureido group; sulfonyloxy groups such as a methanesulfonyloxy group or a p-toluenesulfonyloxy group; heterocyclic groups such as a 1-morpholino group, a 1-piperidino group, a 2-pyridyl group, a 4-pyridyl group, a 2-thienyl group, a 1-pyrazolyl group, a 2-imidazolyl group, a 2-tetrahydrofuryl group or a 2-tetrahydrothienyl group; and a cyano group. Z' does not represent a sulfonic acid group, a carboxylic acid group, a hydroxyl group, or an alkoxycarbonyl group such as a methoxycarbonyl group or an ethoxycarbonyl group.

When Y' represents

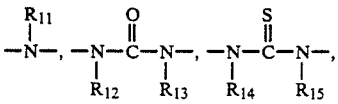

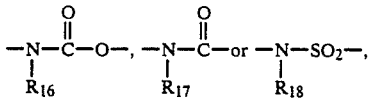

$R_{11}$, $R_{12}$, $R_{13}$, $R_{14}$, $R_{15}$, $R_{16}$, $R_{17}$ or $R_{18}$ each represents a hydrogen atom, a substituted or unsubstituted alkyl group such as a methyl group, an ethyl group, a propyl group or a 2-dimethylaminoethyl group, a substituted or unsubstituted aryl group such as a phenyl group or a 2-methylphenyl group, a substituted or unsubstituted alkenyl group such as a propenyl group or a 1-methylvinyl group, or a substituted or unsubstituted aralkyl group such as a benzyl group or a phenethyl group.

Specific examples of compounds of general formula (II) are shown below, however, the present invention is not to be construed as being limited thereto:

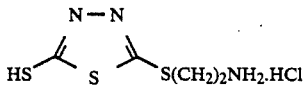

(II-1)

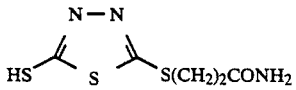

(II-2)

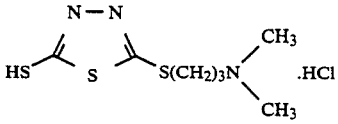

(II-3)

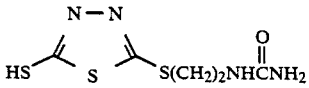

(II-4)

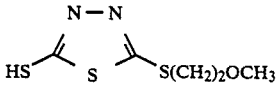

(II-5)

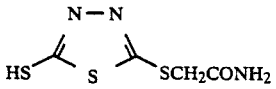

(II-6)

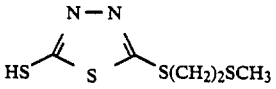

(II-7)

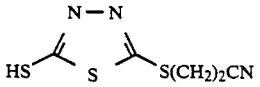

(II-8)

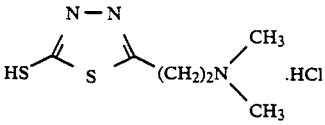

(II-9)

-continued

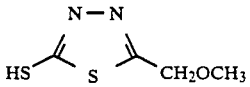

(II-10)

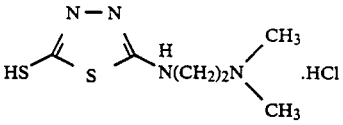

(II-11)

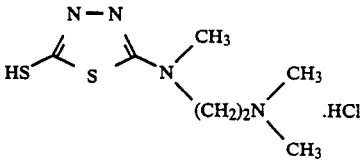

(II-12)

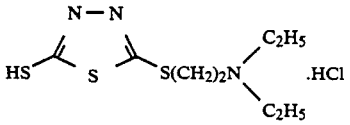

(II-13)

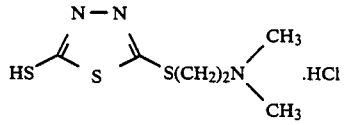

(II-14)

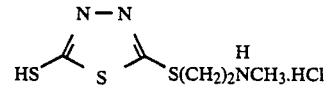

(II-15)

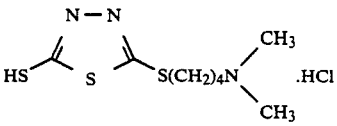

(II-16)

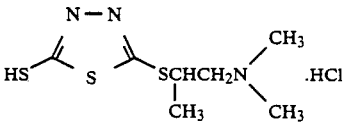

(II-17)

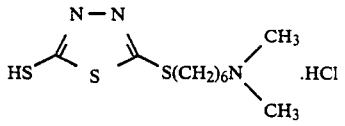

(II-18)

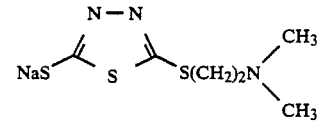

(II-19)

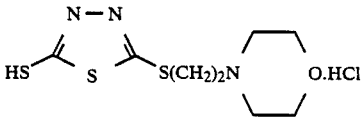

(II-20)

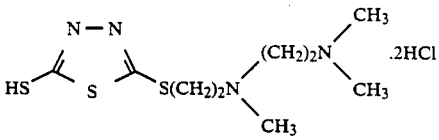

(II-21)

-continued
(II-22)
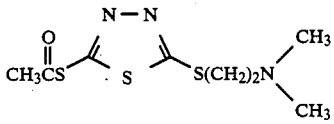
(II-23)
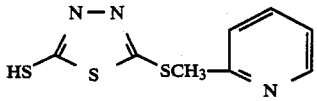
(II-24)
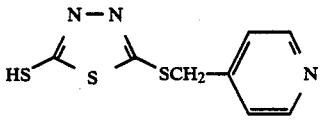
(II-25)
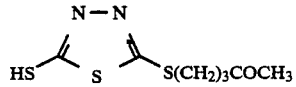
(II-26)
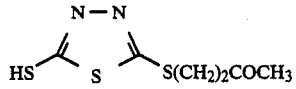
(II-27)
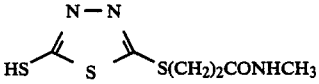
(II-28)
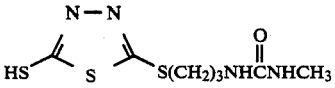
(II-29)
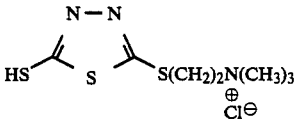
(II-30)
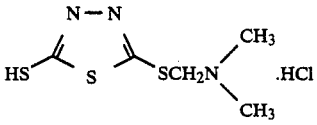
(II-31)
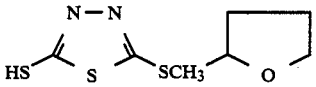
(II-32)
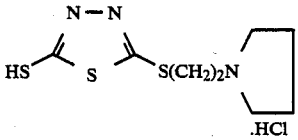
(II-33)
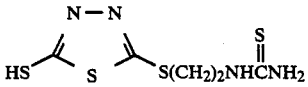
(II-34)
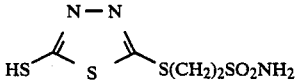
(II-35)
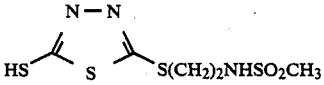
-continued
(II-36)
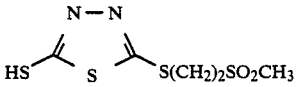
(I-37)
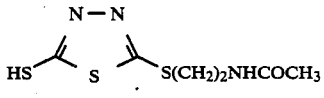
(II-38)
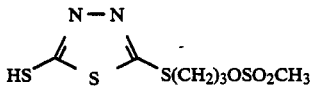
(II-39)
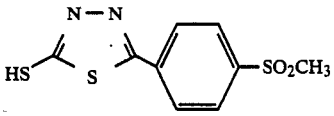
(II-40)
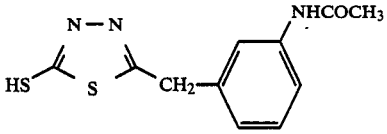
(II-41)
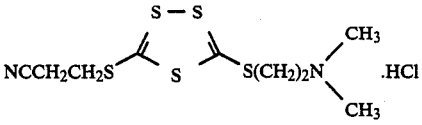
(II-42)
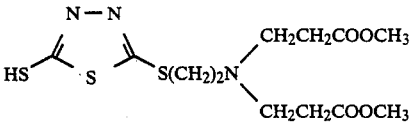
(II-43)
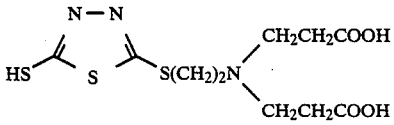
(II-44)
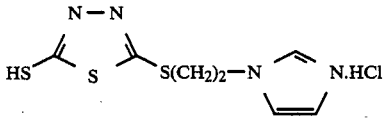
(II-45)
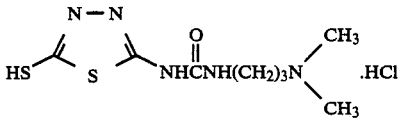
(II-46)
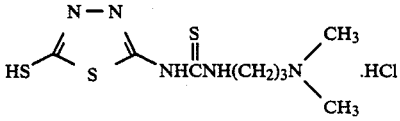
(II-47)
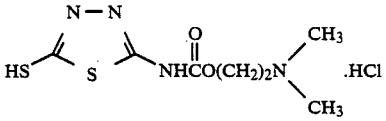

-continued (II-48)

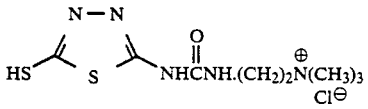

(II-49)

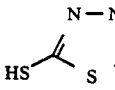

(II-50)

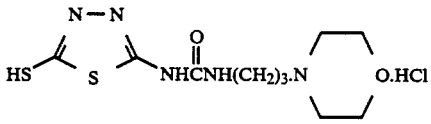

(II-51)

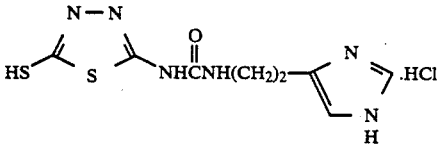

(II-52)

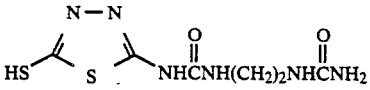

(II-53)

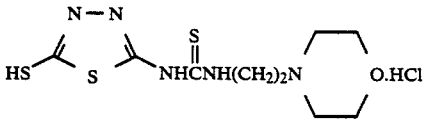

(II-54)

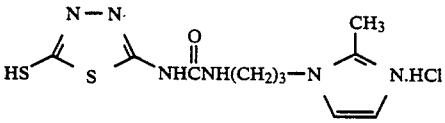

(II-55)

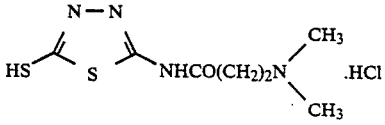

(II-56)

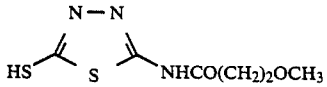

(II-57)

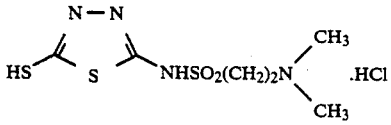

(II-58)

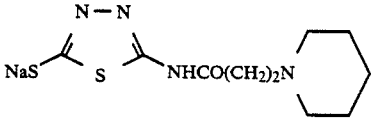

(II-59)

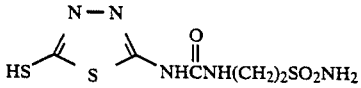

(II-60)

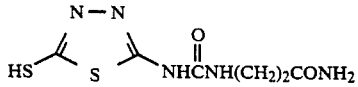

-continued (II-61)

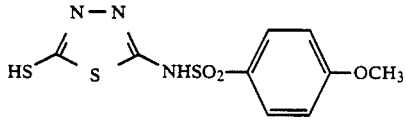

(II-62)

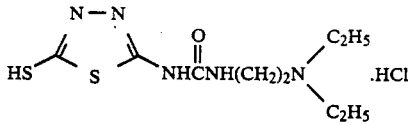

(II-63)

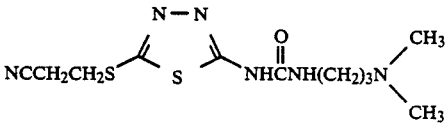

(II-64)

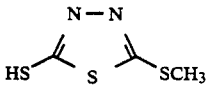

(II-65)

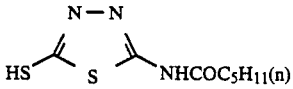

The compounds of general formula (II) used in the present invention may be synthesized in accordance with the methods described in *Advances in Heterocyclic Chemistry,* Vol. 9, pp. 165–209 (1968), *Journal of Pharmaceutical Society, Japan,* Vol. 71, pp. 1481–1484 (1951), and U.S. Pat. No. 2,823,208, which are expressly incorporated herein by reference. Compounds of general formula (II) in which Y′ represents a ureido group or a thioureido group can be easily synthesized by reacting 2-amino-5-mercapto-1,3,4-thiadiazole with an isocyanate or isothiocyanate, or by reacting 2-mercapto-5-phenoxycarbonylamino-1,3,4-thiadiazole with an amine.

Typical synthesis examples are given below.

SYNTHESIS EXAMPLE 1

Method of Synthesis of Compound (II-1)

To 60 ml of n-butanol were added 7.5 g of 2,5-dimercapto-1,3,4-thiadiazole, 5.8 g of 2-aminoethyl chloride hydrochloride and 4 g of pyridine, and the mixture was heated under reflux for 2 hours. The reaction mixture was cooled with ice, and the precipitated crystals were collected by filtration, and recrystallized from a mixture of methanol and water to give 7.1 g of the desired compound. Melting Point: 228°–229° C. (decomp.).

SYNTHESIS EXAMPLE 2

Method of Synthesis of Compound (II-14)

To 60 ml of n-butanol were added 7.5 g of 2,5-dimercapto-1,3,4-thiadiazole, 7.3 g of 2-dimethylaminoethyl chloride hydrochloride and 4 g of pyridine, and the mixture was heated under reflux for 2 hours. The reaction mixture was cooled with ice. The precipitated crystals were collected by filtration and recrystallized from ethanol to give 7.9 g of the desired compound. Melting Point: 161°–163° C.

SYNTHESIS EXAMPLE 3

Method of Synthesis of Compound (II-13)

To 60 ml of n-butanol were added 7.5 g of 2,5-dimercapto-1,3,4-thiadiazole, 8.6 g of 2-diethylaminoethyl chloride hydrochloride and 4 g of pyridine, and the mixture was heated under reflux for 2 hours. The reaction mixture was cooled. The precipitated crystals were collected by filtration and recrystallized from a mixture of ethanol and water to give 10.1 g of the desired compound having a melting point of 184° to 186° C.

SYNTHESIS EXAMPLE 4

Method of Synthesis of Compound (II-3)

To 60 ml of n-butanol were added 7.5 g of 2,5-dimercapto-1,3,4-thiadiazole, 7.9 g of 3-dimethylaminopropyl chloride hydrochloride and 4 g of pyridine, and the mixture was heated under reflux for 2 hours. The reaction mixture was cooled with ice. The precipitated crystals were collected by filtration and recrystallized from ethanol to give 11 g of the desired compound. Melting Point: 149°–152° C.

SYNTHESIS EXAMPLE 5

Method of Synthesis of Compounds (II-42) and (II-43)

(1) Synthesis of 2-[N,N-bis(2-methoxycarbonylethylamino]ethyl chloride hydrochloride To 75 ml of methanol was added 6.1 g of 2-aminoethanol, and 20 ml of methyl acrylate was added dropwise under ice cooling. After the addition, the mixture was stirred for 2 hours under ice cooling and further for 20 hours at room temperature. The reaction mixture was subjected to evaporation under reduced pressure, and 100 ml of chloroform was added to 23 g of the resulting oil. Thionyl chloride (8.7 ml) was added dropwise under ice cooling, and the mixture was heated under reflux for 1 hour. The reaction mixture was subjected to evaporation under reduced pressure, and the residue was recrystallized from a mixture of isopropanol and n-hexane to give 21 g of the desired compound. Melting Point: 103°–104° C.

(2) Method of synthesis of Compound (II-42)

To 80 ml of dioxane were added 7.5 g of 2,5-dimercaptothiadiazole, 14.4 g of 2-[N,N-bis(2-methoxycarbonylethyl)amino]ethyl chloride and 8.1 g of pyridine, and the mixture was heated under reflux for 2 hours. The reaction mixture was evaporated under reduced pressure, and the residue was purified by column chromatography (fixed bed: aluminum; developing solvent: methanol/ethyl acetate) to give 8.4 g of the desired Compound (II-42) as a syrup.

(3) Method of synthesis of Compound (II-43)

Compound (II-42) (7.3 g) was added to 20 ml of a 20% aqueous solution of sodium hydroxide, and the mixture was stirred at 50° C. for 2 hours. The reaction mixture was neutralized with 35% hydrochloric acid with ice cooling. The resulting precipitate was collected by filtration and recrystallized from a mixture of dimethylformamide and ethanol to give 3.2 g of Compound (II-43). Melting Point: 188°–189° C.

SYNTHESIS EXAMPLE 6

Method of Synthesis of Compound (II-4)

To 100 ml of ethanol were added 15.0 g of 2,5-dimercapto-1,3,4-thiadiazole and 28% sodium methoxide solution, and 13.5 g of 2-chloroethylurea was added dropwise to the resulting solution. The mixture was heated under reflux for 4 hours. The reaction mixture was poured into 700 ml of ice water, and the precipitated crystals were collected by filtration and recrystallized from methanol to give 16.4 g of the desired compound. Melting Point: 174°–176° C.

SYNTHESIS EXAMPLE 7

Method of Synthesis of Compound (II-2)

15 g of 2,5-dimercapto-1,3,4-thiadiazole was added to 300 ml of acetone, and then 22 ml of 28% sodium methoxide solution and 12 g of β-chloropropionamide were added.

Furthermore, 15 g of sodium iodide was added to the reaction mixture, and the mixture was heated under reflux for 20 hours. After cooling, the resulting crystals were collected by filtration and washed with water. The crystals were recrystallized from a mixture of dimethylformamide and methanol to give 12.0 g of Compound (II-2). Melting Point: 175°–177° C.

SYNTHESIS EXAMPLE 8

Method of Synthesis of Compound (II-44)

To 100 ml of acetonitrile were added 15.0 g of 2,5-dimercapto-1,3,4-thiadiazole, 20.0 g of 1-(2-chloroethyl-)imidazole hydrochloride and 9.5 g of pyridine, and the mixture was heated under reflux for 4 hours. After the reaction, the reaction solution was cooled, and the precipitated crystals were collected by filtration, and recrystallized from a mixed solvent of dimethylformamide and methanol to give Compound (II-44). Amount Yielded: 11.2 g. Melting Point: 226°–228° C.

SYNTHESIS EXAMPLE 9

Method of Synthesis of Compound (II-45)

Acetonitrile (200 ml) was added to 12.7 g of 2-mercapto-5-phenoxycarbonylamino-1,3,4-thiadiazole, and 6.2 g of 3-N,N-dimethylaminopropylamine was added dropwise at room temperature. After this addition, the mixture was stirred at 50° C. for 1.5 hours. The precipitated crystals were collected by filtration and recrystallized from a mixed solvent of methanol and concentrated hydrochloric acid to give Compound (II-45). Amount Yielded: 10.7 g Melting Point: 228°–230° C.

SYNTHESIS EXAMPLE 10

Method of Synthesis of Compound (II-46)

13.3 g of 2-amino-5-mercapto-1,3,4-thiadiazole was dissolved in 100 ml of acetonitrile and 40 ml of dimethylacetamide, and 15.9 g of 3-(N,N-dimethylamino)-propylisothiocyanate was added dropwise to the solution at room temperature. After this addition, the mixture was heated at 50° C. with stirring for 2 hours. The precipitated crystals were collected by filtration, and recrystallized from a mixed solvent of methanol and concentrated hydrochloric acid to give Compound (II-46). Amount Yielded: 12.6 g. Melting Point: 146°–148° C.

SYNTHESIS EXAMPLE 11

Method of Synthesis of Compound (II-50)

Ethanol (100 ml) was added to 12.7 g of 2-mercapto-5-phenoxycarbonylamino-1,3,4-thiadiazole, and 8.7 g of 3-morpholinopropylamine was added dropwise at room temperature. After this addition, the mixture was stirred at room temperature for 5 hours. The precipitated crystals were collected by filtration, and recrystallized from a mixed solvent of methanol and hydrochloric acid to give Compound (II-50). Amount Yielded: 10.9 g. Melting Point: 255°-257° C.

The amount of the compound of general formula (I) or (II) added varies depending upon the properties of the silver halide photographic material to which the compound is applied, the purpose for which the material is to be used, as well as the method of development processing. Generally, however, the amount is from about 1 to about $10^{-5}$ mol, preferably $3\times10^{-1}$ to $3\times10^{-4}$ mol, per mol of silver halide present in same layer or an adjacent layer.

To introduce the compound of general formula (I) or (II) into the photographic material, the compound is first dissolved in a solvent conventionally employed in photographic materials (such as water, methanol, ethanol, propanol, or fluorinated alcohol), and then added to a hydrophilic colloid. As to incorporating the compound into a silver halide emulsion layer, it may be added during formaiton of silver halide emulsion grains, during physical ripening thereof, immediately before chemical sensitization, during chemical sensitization, after chemical sensitization, or during preparation of the coating solution according to the desired purpose.

The types of photographic material to which the present invention is applicable may be any of color photographic materials such as a color negative film, a color reversal film (internal or external type), a color paper, a color positive film, a color reversal paper, a photographic material for a color diffusion transfer process, and a photographic material for a dye transfer process. The present invention is particularly preferably applied to color reversal films and color reversal papers.

A preferred silver halide for inclusion in a photographic emulsion layer in the photographic material of the present invention is silver iodobromide, silver iodochloride or silver iodochlorobromide containing not more than about 30 mol% of silver iodide. Silver iodobromide containing about 2 mol% to about 25 mol% of silver iodide is especially preferred.

The silver halide grains in the photographic emulsion may have a regular crystal form such as a cubic, octahedral or tetradecahedral form, an irregular crystal form such as a spherical or plate-like form, or may contain crystal defects such as a twin plane, or may be a combination thereof.

The silver halide grains may have a relatively small particle size, i.e., less than about 0.1 micron, or may have a projection area diameter of up to as large as about 10 microns, and may be in the form of a polydispersed emulsion or monodispersed emulsion.

Suitable silver halide photographic emulsions that can be used in the present invention may be prepared, for example, by the methods described in *Research Disclosure* (*RD*), No. 17643 (December, 1978), pp. 22-23, "Emulsion Preparation and Types", *Research Disclosure RD*, No. 18716 (November, 1979), p. 648, Glafkides, *Chimie et Physique Photographique*, Paul Montel, 1967, G. F. Duffin, Photographic Emulsion Chemistry, Focal Press, 1966, and V. L. Zelikman et al., *Making and Coating Photographic Emulsion*, Focal Press, 1964.

The monodispersed emulsions described in U.S. Pat. Nos. 3,574,628 and 3,655,394 and British Pat. No. 1,413,748 are also preferred. Plate-like silver halide grains having an aspect ratio of at least about 5 can also be used in accordance with the present invention. The plate-like grains may be prepared easily by the methods described, for example, in Gutoff, *Photographic Science and Engineering*, Vol. 14, pp. 248-257 (1970), U.S. Pat. Nos. 4,434,226, 4,414,310, 4,433,048 and 4,439,520 and British Pat. No. 2,112,157.

The silver halide grains may be of a uniform crystal structure, or may have different halogen compositions between the interior and exterior portions thereof, or may have a layered structure. A silver halide of a different composition may be epitaxially added, or a compound other than silver halide, such as silver rhodanide or lead oxide may be epitaxially conjugated.

A mixture of grains having various crystal forms may also be used, if desired.

The silver halide emulsion is usually employed after it has been subjected to physical ripening, chemical ripening and spectral sensitization. Additives used in such steps are described in the above-noted RD No. 17643 and RD No. 18716, and the pertinent portions thereof are tabulated hereinbelow.

Other known photographic additives that can be used in the present invention are also described in the above-mentioned two *Research Disclosure* publications, and the pertinent portions are also tabulated hereinbelow:

| Type of Additive | RD 17643 | RD 18716 |
|---|---|---|
| 1 Chemical sensitizer | Page 23 | Page 648, right column |
| 2 Sensitivity increasing agent | | ditto |
| 3 Spectral sensitizer, Supersensitizer | Pages 23-24 | Page 648, right column to page 649, right column |
| 4 Bleaching agent | Page 24 | |
| 5 Antifoggant and Stabilizer | Pages 24-25 | Page 649, right column |
| 6 Light absorber, Filter dye, Ultraviolet absorber | Pages 25-26 | Page 649, right column to page 650, right column |
| 7 Stain inhibitor | Page 25, right column | Page 650, left to right columns |
| 8 Dye image stabilizer | Page 25 | |
| 9 Hardener | Page 26 | Page 651, left column |
| 10 Binder | Page 26 | " |
| 11 Plasticizer, Lubricant | Page 27 | Page 650, right column |
| 12 Coating aids, Surface active agent | Pages 26-27 | " |
| 13 Antistatic agent | Page 27 | " |

Various color couplers can be used in the present invention, and specific examples thereof are described in the patents cited in the above-cited *Research Disclosure*, No. 17643, § VII-C-G.

Preferred yellow couplers are described, for example, in U.S. Pat. Nos. 3,933,501, 4,022,620, 4,326,024 and 4,401,752, Japanese Patent Publication No. 10739/83, and British Pat. Nos. 1,425,020 and 1,476,760.

Preferred magenta couplers are 5-pyrazolone type and pyrazoloazole type compounds. Especially preferred magenta couplers are described in U.S. Pat. Nos. 4,310,619 and 4,351,897, European Pat. No. 73,636, U.S. Pat. Nos. 3,061,432 and 3,725,067, *Research Disclosure*, No. 24220 (June, 1984), Japanese patent application (OPI) No. 33552/85, *Research Disclosure,* No. 24230 (June, 1984), Japanese patent application (OPI) No. 43659/85, U.S. Pat. Nos. 4,500,630 and 4,540,654.

Suitable cyan couplers are, for example, phenol type and naphthol type couplers. Preferred examples include those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German patent application (OLS) No. 3,329,729, European Pat. No. 121,365A, U.S. Pat. Nos. 3,446,622, 4,333,999, 4,451,559 and 4,427,767, and European Pat. No. 161,626A.

Preferred colored couplers for correcting the undesired absorptions of coloring dyes are described for example, in *Research Disclosure,* No. 17643, § VIII-G, U.S. Pat. No. 4,163,670, Japanese Patent Publication No. 39413/82, U.S. Pat. Nos. 4,004,929 and 4,138,258 and British Pat. No. 1,146,368.

Preferred couplers which permit formation of colored dyes having moderate diffusibility are described, for example, in U.S. Pat. No. 4,366,237, British Pat. No. 2,125,570, European Pat. No. 96,570, and West German patent application (OLS) No. 3,234,533.

Typical examples of polymerized dye-forming couplers are described, for example, in U.S. Pat. Nos. 3,451,820, 4,080,211 and 4,367,282, and British Pat. No. 2,102,173.

Couplers which release photographically useful residues upon coupling may also be preferably used in the present invention. Preferred DIR couplers which release development inhibitors are described in Japanese patent application (OPI) Nos. 151944/82, 154234/82 and 184248/85 and U.S. Pat. No. 4,248,962, which are described in sections VII to F in the above-cited RD 17643.

Preferred couplers which release nucleus-forming agents or development accelerators imagewise at the time of development are described in British Pat. Nos. 2,097,140 and 2,131,188 and Japanese patent application (OPI) Nos. 157638/84 and 170840/84.

Other couplers which can be used in the photographic material of the present invention include, for example, a competitive coupler described in U.S. Pat. No. 4,130,427, polyequivalent couplers described in U.S. Pat. Nos. 4,283,472, 4,338,393 and 4,310,618, a DIR redox compound-releasing coupler described in Japanese patent application (OPI) No. 185950/85, and a coupler which releases a dye convertible to its original color after liberation as described in European Pat. No. 173,302A.

The couplers used in this invention may be introduced into the photographic material by various known dispersing methods. Examples of high boiling point organic solvents used in the oil-in-water dispersing method are described, for example, in U.S. Pat. No. 2,322,027.

The steps and effect of the latex dispersing method and specific examples of latices for impregnation are described, for example, in U.S. Pat. No. 4,199,363 and West German patent application (OLS) Nos. 2,541,274 and 2,541,230.

Suitable supports which can be used in the present invention are described, for example, in the above-cited RD No. 17643, p. 28 and RD No. 18716, p. 647, left column to p. 648, left column.

The color photographic material in accordance with the present invention may be developed by conventional development processing methods, such as those described in the above-cited RD No. 17643, pp. 28 and 29 and RD No. 18716, p. 651, left column to right column.

The color photographic material of the present invention is usually subjected to a water washing treatment or a stabilization treatment after the steps of color development, and bleaching-fixing or fixing treatment.

In such a water washing (rinsing) step, water is generally conserved by countercurrent washing using two or more tanks. In place of the water washing step, the stabilization treatment may typically be carried out by the multistage countercurrent stabilization method described in Japanese patent application (OPI) No. 8543/82.

The following examples are illustrative of certain embodiments of the present invention. It is to be understood, however, that the scope of the present invention is not limited to these examples alone. Unless otherwise indicated, all parts, percents, ratios and the like are by weight.

EXAMPLE 1

A sample of a multilayer color photographic material (Sample 101) composed of a multiplicity of layers having the following compositions on a cellulose triacetate film support was prepared as follows.

First Layer: Antihalation Layer

A gelatin layer (dry thickness: 2 μm) containing:

| | |
|---|---|
| Black colloidal silver | 0.25 g/m$^2$ |
| Ultraviolet Absorber U-1 | 0.04 g/m$^2$ |
| Ultraviolet Absorber U-2 | 0.1 g/m$^2$ |
| Ultraviolet Absorber U-3 | 0.1 g/m$^2$ |
| High Boiling Point Organic Solvent O-1 | 0.1 cc/m$^2$ |

Second Layer: Interlayer

A gelatin layer (dry thickness: 1 μm) containing:

| | |
|---|---|
| Compound H-1 | 0.05 g/m$^2$ |
| High Boiling Point Organic Solvent O-2 | 0.05 cc/m$^2$ |

Third Layer: First Red-Sensitive Emulsion Layer

A gelatin layer (dry thickness: 1 μm) containing:

| | |
|---|---|
| Silver iodobromide emulsion spectrally sensitized with Sensitizing Dyes S-1 (1.4 mg/m$^2$) and S-3 (0.06 mg/m$^2$) (iodine content: 4 mol %, average particle size: 0.3 μm) | 0.5 g/m$^2$ (as silver) |
| Coupler C-1 | 0.2 g/m$^2$ |
| Coupler C-2 | 0.05 g/m$^2$ |
| High Boiling Point Organic Solvent O-2 | 0.12 cc/m$^2$ |

Fourth Layer: Second Red-Sensitive Emulsion Layer

A gelatin layer (dry thickness: 2.5 μm) containing:

| | |
|---|---|
| Silver iodobromide emulsion spectrally sensitized with Sensitizing Dyes S-1 (1.6 mg/m$^2$) and S-2 (0.06 mg/m$^2$) (iodine content: 2.5 mol %, average particle size: 0.55 μm) | 0.8 g/m$^2$ (as silver) |
| Coupler C-1 | 0.55 g/m$^2$ |

-continued

| | |
|---|---|
| Coupler C-2 | 0.14 g/m$^2$ |
| High Boiling Point Organic Solvent O-2 | 0.33 cc/m$^2$ |

Fifth Layer: Interlayer

A gelatin layer (dry thickness: 1 μm) containing:

| | |
|---|---|
| Compound H-1 | 0.1 g/m$^2$ |
| High Boiling Point Organic Solvent O-2 | 0.1 cc/m$^2$ |

Sixth Layer: First Green-Sensitive Emulsion Layer

A gelatin layer (dry thickness: 1 μm) containing:

| | |
|---|---|
| Silver iodobromide emulsion spectrally sensitized with Sensitizing Dyes S-3 (3.3 mg/m$^2$) and S-4 (1.5 mg/m$^2$) (iodine content: 3 mol %, average particle size: 0.3 μm) | 0.7 g/m$^2$ (as silver) |
| Coupler C-3 | 0.35 g/m$^2$ |
| High Boiling Point Organic Solvent O-2 | 0.26 cc/m$^2$ |

Seventh Layer: Second Green-Sensitive Emulsion Layer

A gelatin layer (dry thickness: 2.5 μm) containing:

| | |
|---|---|
| Silver iodobromide emulsion spectrally sensitized with Sensitizing Dyes S-3 (1.3 mg/m$^2$) and S-4 (0.5 mg/m$^2$) (iodine content: 2.5 mol %, average particle size: 0.8 μm) | 0.7 g/m$^2$ (as silver) |
| Coupler C-4 | 0.25 g/m$^2$ |
| High Boiling Point Organic Solvent O-2 | 0.05 cc/m$^2$ |

Eighth Layer: Interlayer

A gelatin layer (dry thickness: 1μm) containing:

| | |
|---|---|
| Compound H-1 | 0.05 g/m$^2$ |
| High Boiling Point Organic Solvent O-2 | 0.1 cc/m$^2$ |

Ninth Layer: Yellow Filter Layer

A gelatin layer (dry thickness: 1 μm) containing:

| | |
|---|---|
| Yellow colloidal silver | 0.1 g/m$^2$ |
| Compound H-1 | 0.02 g/m$^2$ |
| Compound H-2 | 0.03 g/m$^2$ |
| High Boiling Point Organic Solvent O-2 | 0.04 cc/m$^2$ |

Tenth Layer: First Blue-Sensitive Emulsion Layer

A gelatin layer (dry thickness: 1.5 μm) containing:

| | |
|---|---|
| Silver iodobromide emulsion spectrally sensitized with Sensitizing Dye S-5 (1.0 mg/m$^2$) (iodine content: 2.5 mol %, average particle size: 0.7 μm) | 0.6 g/m$^2$ (as silver) |
| Coupler C-5 | 0.5 g/m$^2$ |
| High Boiling Point Organic Solvent O-2 | 0.1 cc/m$^2$ |

Eleventh Layer: Second Blue-Sensitive Emulsion Layer

A gelatin layer (dry thickness: 3 μm) containing:

| | |
|---|---|
| Silver iodobromide emulsion spectrally sensitized with Sensitizing Dye S-5 (1.7 mg/m$^2$) (iodine content: 2.5 mol %, average particle size: 1.2 μm) | 1.1 g/m$^2$ (as silver) |
| Coupler C-5 | 1.2 g/m$^2$ |
| High Boiling Point Organic Solvent O-2 | 0.23 cc/m$^2$ |

Twelth Layer: First Protective Layer

A gelatin layer (dry thickness: 2 μm) containing:

| | |
|---|---|
| Ultraviolet Absorber U-1 | 0.02 g/m$^2$ |
| Ultraviolet Absorber U-2 | 0.03 g/m$^2$ |
| Ultraviolet Absorber U-3 | 0.03 g/m$^2$ |
| Ultraviolet Absorbrr U-4 | 0.29 g/m$^2$ |
| High Boiling Point Organic Solvent O-1 | 0.28 cc/m$^2$ |

Thirteenth Layer: Second Protective Layer

A gelatin layer (dry thickness: 0.8 μm) containing:

| | |
|---|---|
| Surface-fogged silver iodobromide emulsion in fine grains (iodine content: 1 mol %, average particle diameter: 0.06 μm) | 0.1 g/m$^2$ (as silver) |
| Yellow colloidal silver for the yellow filter layer | 0.01 g/m$^2$ (as silver) |
| Polymethyl methacrylate particles (average particle size: 1.5 μm) | |

In addition to the above compositions, Gelatin Hardener H-3 and a surface active agent, sodium dodecylbenzenesulfonate, were added to each of the above layers.

The compounds used to prepare this sample, designated Sample 101, are shown below.

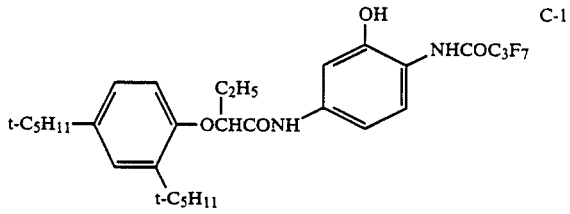

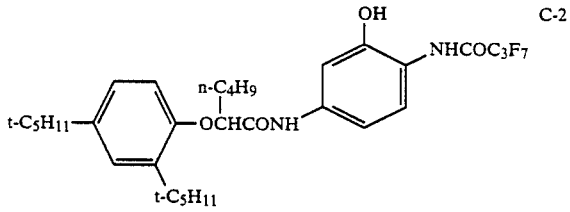

-continued
C-3
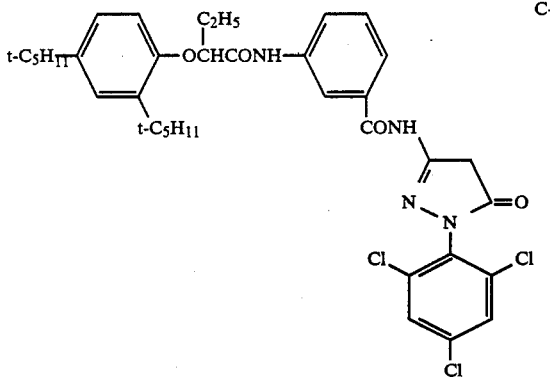
C-4
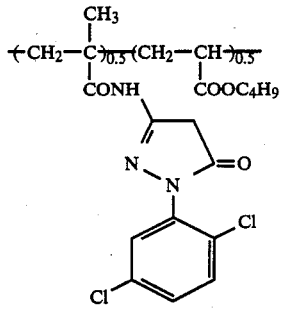
C-5
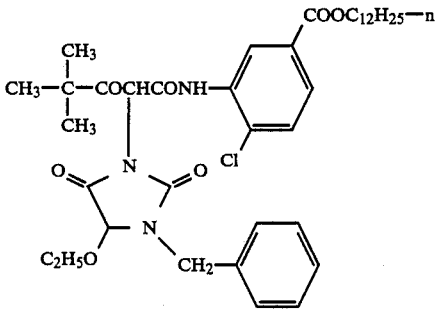
U-1
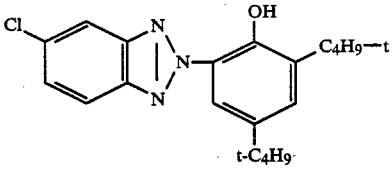
U-2
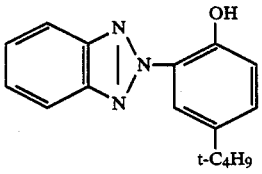
U-3
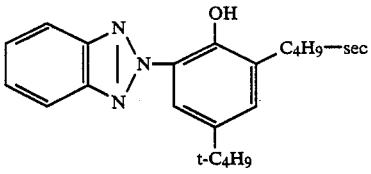
-continued
U-4
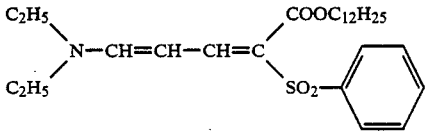
H-1
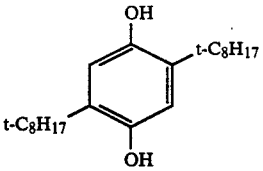
H-2
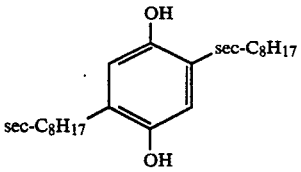
H-3
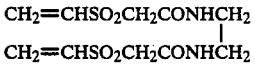
O-1
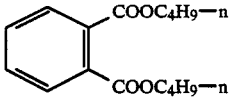
O-2
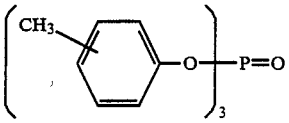
S-1
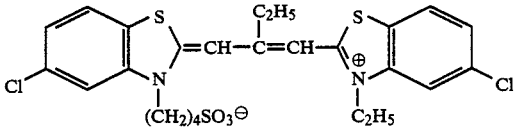
S-2
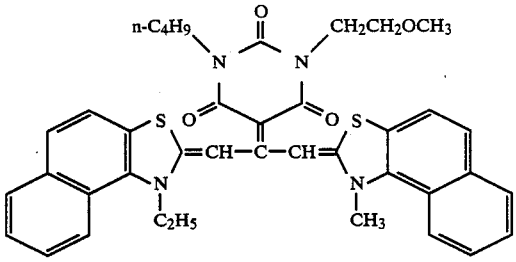
S-3
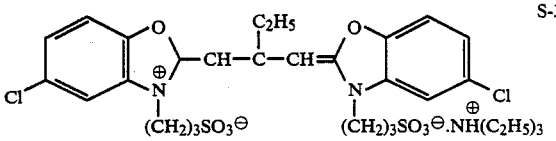
S-4
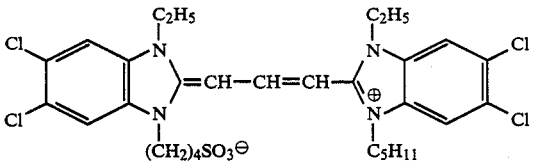

-continued

S-5

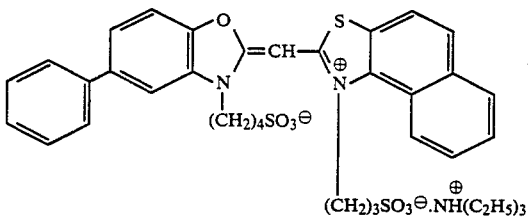

S-6

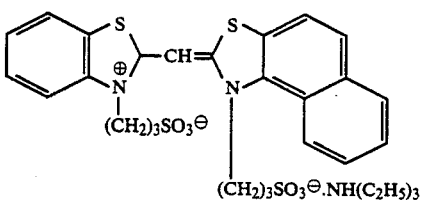

Subsequently, by the controlled double jet method, a silver bromide cubic emulsion having an average particle size of 0.15 μm was prepared, and was fogged with hydrazine and a gold complex salt under a low pAg. The emulsion thus prepared was designed as Emulsion A (surface-fogged emulsion). Emulsion B (internally-fogged emulsion) was prepared by forming a shell of silver bromide having a thickness of 250 Å on the surface of the grains comprising Emulsion A. Emulsion B was not chemically sensitized.

Samples 102 to 120 were prepared in the same manner as in the preparation of Sample 101 except that to Emulsion A and Emulsion B were added the compounds shown in Table 1 to the layers indicated in Table 1.

Each of the resulting samples was exposed through a sensitometric wedge to white light from a light source of 4,800° K. with an exposure surface illuminance of 1,000 luxes, and then subjected to a standard reversal processing step and a reversal sensitizing processing step to be described hereafter thereby forming a colored image.

The processing steps and processing solutions used herein are shown below.

Standard Processing

| Step | Time (min) | Temperature (°C.) |
|---|---|---|
| First Development | 6 | 38 |
| Water Washing | 2 | 38 |
| Reversal | 2 | 38 |
| Color Development | 6 | 38 |
| Adjustment | 2 | 38 |
| Bleaching | 6 | 38 |
| Fixation | 4 | 38 |
| Water Washing | 4 | 38 |
| Stabilization | 1 | Room Temperature |
| Drying | 1 | 65 |

Sensitizing Treatment

| Step | Time (min) | Temperature (°C.) |
|---|---|---|
| First Development | 10 | 38 |
| Water Washing | 2 | 38 |
| Reversal | 2 | 38 |
| Color Development | 6 | 38 |
| Adjustment | 2 | 38 |
| Bleaching | 6 | 38 |
| Fixation | 4 | 38 |
| Water Washing | 4 | 38 |
| Stabilization | 1 | Room |

-continued

| | | Temperature |
|---|---|---|
| Drying | 1 | 65 |

The processing solutions had the following compositions.

| | |
|---|---|
| **First Developer** | |
| Water | 700 ml |
| Pentasodium Nitrilo-N,N,N—trimethylene-phosphonate | 2 g |
| Sodium Bisulfate | 20 g |
| Hydroquinone Monosulfonate | 30 g |
| Sodium Carbonate Monohydrate | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1 wt/vol % soln.) | 2 ml |
| Water to make | 1,000 ml |
| **Reversal Solution** | |
| Water | 700 ml |
| Pentasodium Nitril-N,N,N—trimethylene-phosphonate | 3 g |
| Stannous Chloride Dihydrate | 1 g |
| p-Aminophenol | 0.1 g |
| Sodium Hydroxide | 8 g |
| Glacial Acetic Acid | 15 ml |
| Water to make | 1,000 ml |
| **Color Developer** | |
| Water | 700 ml |
| Pentasodium Nitrilo-N,N,N—trimethylene-phosphonate | 3 g |
| Sodium Sulfite | 7 g |
| Sodium Tertiary Phosphate Dodecahydrate | 36 g |
| Potassium Bromide | 1 g |
| Potassium Iodide (0.1 wt/vol % soln.) | 90 ml |
| Sodium Hydroxide | 3 g |
| Citrazinic Acid | 1.5 g |
| N—Ethyl-N—(β-methanesulfonamidoethyl)-3-methyl-4-aminoaniline Sulfate | 11 g |
| 3,6-Dithiaoctane-1,8-diol | 1 g |
| Water to make | 1,000 ml |
| **Adjusting Solution** | |
| Water | 700 ml |
| Sodium Sulfite | 12 g |
| Sodium Ethylenediaminetetraacetate Dihydrate | 8 g |
| Thioglycerin | 0.4 ml |
| Glacial Acetic Acid | 3 ml |
| Water to make | 1,000 ml |
| **Bleaching Solution** | |
| Water | 800 ml |
| Sodium Ethylenediaminetetraacetate Dihydrate | 2 g |
| Ammonium Iron (III) Ethylenediamine-tetraacetate Dihydrate | 120 g |
| Potassium Bromide | 100 g |
| Water to make | 1,000 ml |
| **Fixing Solution** | |
| Water | 800 ml |
| Sodium Thiosulfate | 80.0 g |
| Sodium Sulfite | 5.0 g |
| Sodium Bisulfate | 5.0 g |
| Water to make | 1,000 ml |
| **Stabilizing Solution** | |
| Water | 800 ml |
| Formalin (37% by weight) | 5.0 ml |
| Fuji Driwel (sodium dodecylbenzene-sulfonate, surfactant made by Fuji Photo Film Co., Ltd. | 5.0 ml |
| Water to make | 1,000 ml |

The optical densities of cyan and magenta images of each of the resulting samples were measured through red and green filters, and their sensitizing developabilities were also evaluated.

From the photographic characteristic curves, the sensitivities ($S_{1.2}$ and $S_{0.4}$) were expressed by logarithms of the reciprocals of the amounts of exposure required to obtain constant cyan and magenta densities (D=1.2 and D=0.4, respectively). As the difference in sensitivity at the cyan density or the magenta density between a first development time of 10 minutes and a first developing time of 6 minutes ($\Delta S_{(R)1.2}$, $\Delta S_{(R)0.4}$, $\Delta_{(G)1.2}$, and $\Delta S_{(G)0.4}$) becomes greater, the extent of sensitization is seen to be greater. Furthermore, as the difference between the extent of sensitization at D=1.2 and the extent of sensitization at D=0.4 becomes smaller, variations in gradation due to push development can be seen to be less. The changes in the maximum densitites ($\Delta D_{max}$) at a first development time of 10 minutes and 6 minutes were also measured. The results are shown in Table 1.

The same results were obtained when washing after fixation was carried out by using a rinsing solution of the following formulation.

Rinsing Solution:

| | |
|---|---|
| Disodium Ethylenediaminetetraacetate | 0.4 g |
| Water to make | 1,000 ml |
| pH adjusted with sodium hydroxide | pH: 7.0 |

TABLE 1

| Sample No. | Compound Added (amount: $1 \times 10^{-5}$ mol/m$^2$) | Layer Having the Compound Added Thereto | Fogged Emulsion (amount: 0.05 g/m$^2$) | Layer Having the Fogged Emulsion Added Thereto | $\Delta S_{1.2}$ at the Cyan Density | $\Delta S_{0.4}$ at the Cyan Density | $(\Delta S_{0.4}-\Delta S_{1.2})$ at the Cyan Density | $\Delta S_{1.2}$ at the Magenta Density | $\Delta S_{0.4}$ at the Magenta Density | $(\Delta S_{0.4}-\Delta S_{1.2})$ Magenta Density | $\Delta D_{max}$ at the Cyan Density | $\Delta D_{max}$ at the Magenta Density |
|---|---|---|---|---|---|---|---|---|---|---|---|---|
| 101 (Comparison) | — | — | — | — | 0.45 | 0.67 | 0.22 | 0.38 | 0.61 | 0.23 | 0.25 | 0.23 |
| 102 (Comparison) | (I-1) | 1st layer | — | — | 0.44 | 0.61 | 0.17 | 0.37 | 0.55 | 0.18 | 0.18 | 0.17 |
| 103 (Comparison) | (I-1) | 9th layer | — | — | 0.45 | 0.63 | 0.18 | 0.37 | 0.54 | 0.17 | 0.18 | 0.16 |
| 104 (Comparison) | Compound A | 1st layer | — | — | 0.45 | 0.68 | 0.23 | 0.38 | 0.61 | 0.23 | 0.25 | 0.25 |
| 105 (Comparison) | — | — | Emulsion A | 3rd and 6th layers | 0.64 | 0.76 | 0.12 | 0.58 | 0.69 | 0.11 | 0.43 | 0.45 |
| 106 (Comparison) | — | — | Emulsion B | " | 0.63 | 0.74 | 0.11 | 0.57 | 0.67 | 0.10 | 0.37 | 0.34 |
| 107 (Comparison) | Compound A | 1st layer | " | " | 0.62 | 0.73 | 0.11 | 0.58 | 0.67 | 0.11 | 0.36 | 0.33 |
| 108 (Comparison) | " | 9th layer | " | " | 0.62 | 0.74 | 0.12 | 0.57 | 0.66 | 0.09 | 0.37 | 0.33 |
| 109 (Invention) | (I-1) | 1st layer | " | " | 0.63 | 0.69 | 0.06 | 0.57 | 0.61 | 0.04 | 0.19 | 0.19 |
| 110 (Invention) | " | 9th layer | " | " | 0.63 | 0.70 | 0.07 | 0.56 | 0.61 | 0.05 | 0.19 | 0.18 |
| 111 (Invention) | " | 1st layer | Emulsion A | " | 0.63 | 0.70 | 0.07 | 0.58 | 0.62 | 0.04 | 0.22 | 0.21 |
| 112 (Invention) | " | 9th layer | " | " | 0.63 | 0.70 | 0.07 | 0.58 | 0.61 | 0.03 | 0.22 | 0.21 |
| 113 (Invention) | (I-5) | 1st layer | Emulsion B | 3rd and 6th layers | 0.62 | 0.70 | 0.08 | 0.57 | 0.62 | 0.05 | 0.19 | 0.18 |
| 114 (Invention) | (I-20) | " | " | " | 0.63 | 0.69 | 0.06 | 0.58 | 0.61 | 0.03 | 0.19 | 0.18 |
| 115 (Invention) | (I-24) | " | " | " | 0.63 | 0.70 | 0.07 | 0.58 | 0.62 | 0.04 | 0.20 | 0.19 |
| 116 (Invention) | (II-3) | " | " | " | 0.63 | 0.69 | 0.06 | 0.58 | 0.62 | 0.04 | 0.18 | 0.1 |
| 117 (Invention) | (II-4) | " | " | " | 0.62 | 0.69 | 0.07 | 0.57 | 0.61 | 0.04 | 0.18 | 0.17 |
| 118 (Invention) | (II-20) | " | " | " | 0.63 | 0.70 | 0.07 | 0.58 | 0.62 | 0.04 | 0.19 | 0.18 |
| 119 (Invention) | (II-44) | " | " | " | 0.63 | 0.69 | 0.06 | 0.58 | 0.62 | 0.04 | 0.18 | 0.17 |
| 120 (Invention) | (II-58) | " | " | " | 0.62 | 0.69 | 0.07 | 0.57 | 0.61 | 0.04 | 0.19 | 0.18 |

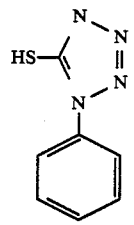

Compound A

It is seen from Table 1 that since the photographic materials in accordance with this invention have a larger extent of sensitization than Comparative Examples 101 (blank) and 102 to 104, variations in gradation due to the push development are smaller. It is also seen that the photographic materials of this invention have a smaller extent of sensitization at D=0.4 than Comparative Examples 105 to 108, but show less variations in gradation due to the push development and also less variations in $D_{max}$.

EXAMPLE 2

A multilayer color photographic material was prepared by forming layers of the following compositions on an undercoated cellulose triacetate film support (Sample 201).

First Layer: Antihalation Layer

A gelatin layer (dry thickness: 2 μm) containing:

| | |
|---|---|
| Black colloidal silver | 0.25 g/m$^2$ |
| Ultraviolet Absorber U-1 | 0.04 g/m$^2$ |
| Ultraviolet Absorber U-2 | 0.1 g/m$^2$ |
| Ultraviolet Absorber U-3 | 0.1 g/m$^2$ |
| High Boiling Point Organic Solvent O-1 | 0.1 cc/m$^2$ |

Second Layer: Interlayer

A gelatin layer (dry thickness: 1 μm) containing:

| | |
|---|---|
| Compound H-1 | 0.05 g/m$^2$ |
| High Boiling Point Organic Solvent O-2 | 0.05 cc/m$^2$ |

Third Layer: First Red-Sensitive Emulsion Layer

A gelatin layer (dry thickness: 0.7 μm) containing:

| | |
|---|---|
| Monodispersed silver iodobromide emulsion spectrally sensitized with Sensitizing Dyes S-1 (0.93 mg/m$^2$) and S-2 (0.04 mg/m$^2$) (iodine content: 4 mol %, average particle size: 0.3 μm, variation coefficient relating to particle size (to be abbreviated simply as variation coefficient): 19%) | 0.33 g/m$^2$ (as silver) |
| Coupler C-1 | 0.13 g/m$^2$ |
| Coupler C-2 | 0.033 g/m$^2$ |
| High Boiling Point Organic Solvent O-2 | 0.08 cc/m$^2$ |

Fourth Layer: Second Red-Sensitive Emulsion Layer

A gelatin layer (dry thickness: 1.7 μm) containing:

| | |
|---|---|
| Monodispersed silver iodobromide emulsion spectrally sensitized with Sensitizing Dyes S-1 (1.1 mg/m$^2$) and S-2 (0.04 mg/m$^2$) (iodine content: 3 mol %, | 0.53 g/m$^2$ (as silver) |

-continued

| | |
|---|---|
| average particle size: 0.5 μm, variation coefficient: 16%) | |
| Coupler C-1 | 0.40 g/m$^2$ |
| Coupler C-2 | 0.07 g/m$^2$ |
| High Boiling Point Organic Solvent O-2 | 0.22 cc/m$^2$ |

Fifth Layer: Third Red-Sensitive Emulsion Layer

A gelatin layer (dry thickness: 1.8 μm) containing:

| | |
|---|---|
| Monodispersed silver iodobromide emulsion spectrally sensitized with Sensitizing Dyes S-1 (1.1 mg/m$^2$) and S-2 (0.04 mg/m$^2$) (iodine content: 2 mol %, average particle size: 0.6 μm, variation coefficient: 17%) | 0.53 g/m$^2$ (as silver) |
| Coupler C-1 | 0.44 g/m$^2$ |
| Coupler C-2 | 0.08 g/m$^2$ |
| High Boiling Point Organic Solvent O-2 | 0.24 cc/m$^2$ |

Sixth Layer: Interlayer

A gelatin layer (dry thickness: 1 μm) containing:

| | |
|---|---|
| Compound H-1 | 0.1 g/m$^2$ |
| High Boiling Point Organic Solvent O-2 | 0.1 cc/m$^2$ |

Seventh Layer: First Green-Sensitive Emulsion Layer

A gelatin layer (dry thickness: 0.7 μm) containing:

| | |
|---|---|
| Monodispersed silver iodobromide emulsion spectrally sensitized with Sensitizing Dyes S-3 (2.2 mg/m$^2$) and S-4 (1.0 mg/m$^2$) (iodine content: 3 mol %, average particle size: 0.3 μm, variation coefficient: 19%) | 0.5 g/m$^2$ (as silver) |
| Coupler C-6 | 0.27 g/m$^2$ |
| High Boiling Point Organic Solvent O-2 | 0.17 cc/m$^2$ |

Eighth Layer: Second Green-Sensitive Emulsion Layer

A gelatin layer (dry thickness: 1.7 μm) containing:

| | |
|---|---|
| Monodispersed silver iodobromide emulsion spectrally sensitized with Sensitizing Dyes S-3 (0.9 mg/m$^2$) and S-4 (0.3 mg/m$^2$) (iodine content: 2.5 mol %, average particle size: 0.5 μm, variation coefficient: 18%) | 0.5 g/m$^2$ (as silver) |
| Coupler C-6 | 0.2 g/m$^2$ |
| High Boiling Point Organic Solvent: O-1 | 0.13 cc/m$^2$ |

Ninth Layer: Third Green-Sensitive Emulsion Layer

A gelatin layer (dry thickness: 1.7 μm) containing:

| | |
|---|---|
| Monodispersed silver iodobromide emulsion spectrally sensitized with Sensitizing Dyes S-3 (0.9 mg/m$^2$) and S-4 (0.3 mg/m$^2$) (iodine content: 2 mol %, average particle size: 0.6 μm, variation coefficient: 17%) | 0.5 g/m$^2$ (as silver) |
| Coupler C-4 | 0.2 g/m$^2$ |
| High Boiling Point Organic Solvent O-2 | 0.03 cc/m$^2$ |

Tenth Layer: Interlayer

A gelatin layer (dry thickness: 1 μm) containing:

| | |
|---|---|
| Compound H-1 | 0.05 g/m$^2$ |
| High Boiling Point Organic Solvent O-2 | 0.1 cc/m$^2$ |

Eleventh Layer: Yellow Filter Layer

A gelatin layer (dry thickness: 1 μm) containing:

| | |
|---|---|
| Yellow colloidal silver | 0.1 g/m$^2$ |
| Compound H-1 | 0.02 g/m$^2$ |
| Compound H-2 | 0.03 g/m$^2$ |
| High Boiling Point Organic Solvent O-2 | 0.04 cc/m$^2$ |

Twelfth Layer: First Blue-Sensitive Emulsion Layer

A gelatin layer (dry thickness: 1.5 μm) containing:

| | |
|---|---|
| Plate-like silver iodobromide emulsion spectrally sensitized with Sensitizing Dye S-5 (1.0 mg/m$^2$) (iodine content: 3 mol %, particles having a diameter/thickness ratio of at least 7 occupy 50% of the projection area of the entire particles, average thickness of the particles: 0.10 μm) | 0.6 g/m$^2$ (as silver) |
| Coupler C-5 | 0.5 g/m$^2$ |
| High Boiling Point Organic Solvent O-2 | 0.1 cc/m$^2$ |

Thirteenth Layer: Second Blue-Sensitive Emulsion Layer

A gelatin layer (dry thickness: 3 μm) containing:

| | |
|---|---|
| Plate-like silver iodobromide emulsion spectrally sensitized with Sensitizing Dye S-5 (2.0 mg/m$^2$) (iodine content: 2.5 mol %, particles having a diameter/thickness ratio of at least 7 occupy 50% of the projection area of the entire particles, average thickness of the particles: 0.15 μm) | 1.1 g/m$^2$ (as silver) |
| Coupler C-5 | 1.2 g/m$^2$ |
| High Boiling Point Organic Solvent O-2 | 0.23 cc/m$^2$ |

Fourteenth Layer: First Protective Layer

A gelatin layer (dry thickness: 2 μm) containing:

| | |
|---|---|
| Ultraviolet Absorber U-1 | 0.02 g/m$^2$ |
| Ultraviolet Absorber U-2 | 0.03 g/m$^2$ |
| Ultraviolet Absorber U-3 | 0.03 g/m$^2$ |
| Ultraviolet Absorber U-4 | 0.29 g/m$^2$ |
| High Boiling Point Organic Solvent O-1 | 0.28 cc/m$^2$ |

Fifteenth Layer: Second Protective layer

A gelatin layer (dry thickness: 0.8 μm) containing:

| | |
|---|---|
| Surface-fogged silver iodobromide emulsion in the form of fine grains (iodine content: 1 mol %, average particle size: 0.06 μm) | 0.1 g/m$^2$ (as silver) |
| Yellow colloidal silver for the yellow filter layer | 0.01 g/m$^2$ (as silver) |
| Polymethyl methacrylate particles (average particle size: 1.5 μm) | |

In addition to the above composition, Gelatin Hardener H-3 and a surface active agent, sodium dodecylbenzenesulfonate, were added to each of the above layers.

The compounds used to prepare the samples are shown below.

C-1

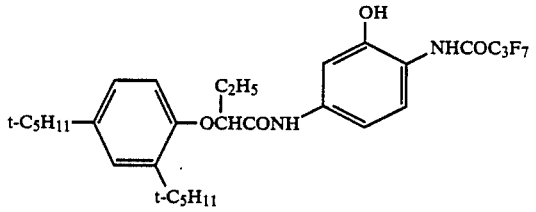

C-2

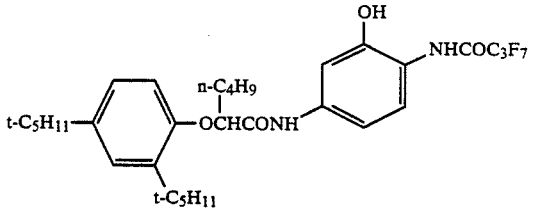

C-6

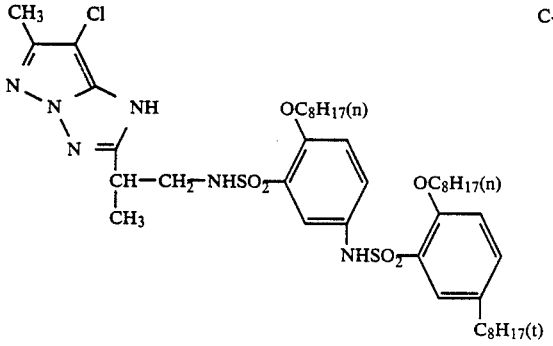

C-4

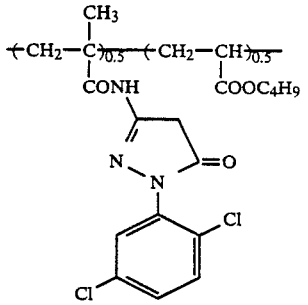

C-5

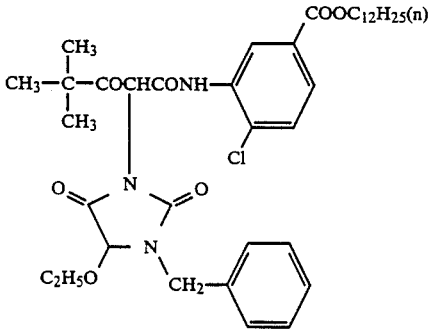

-continued
U-1
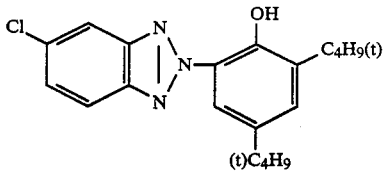
U-2
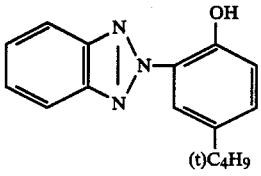
U-3
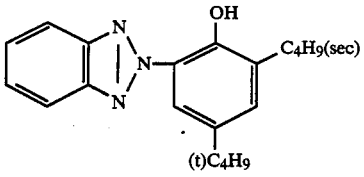
U-4
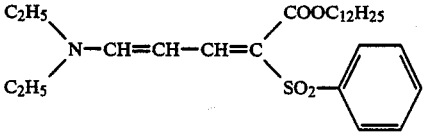
H-1
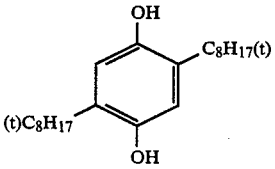
H-2
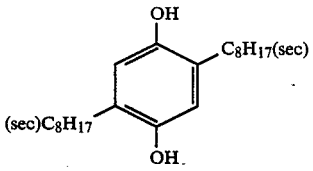
H-3
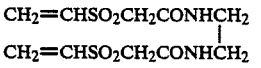
O-1
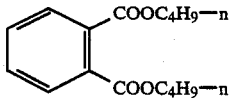
-continued
O-2
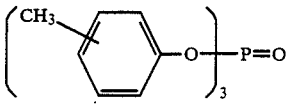
S-1
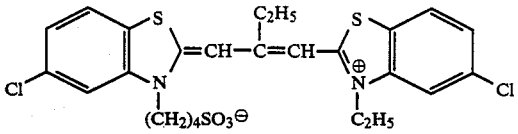
S-2
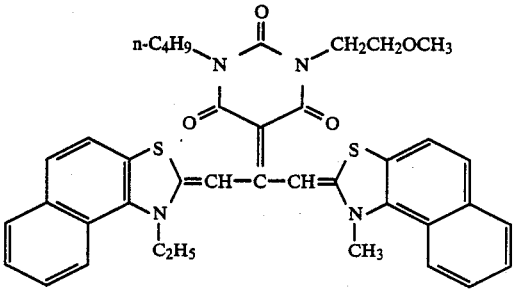
S-3
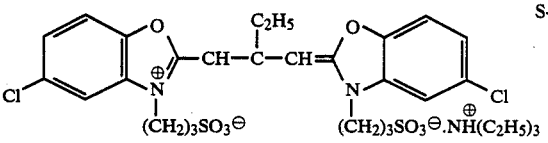
S-4
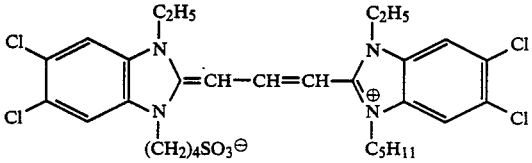
S-5
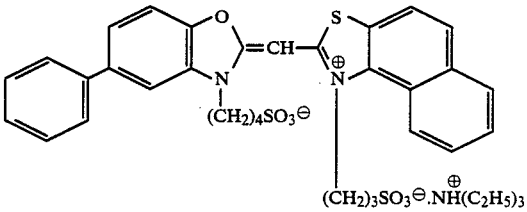
S-6
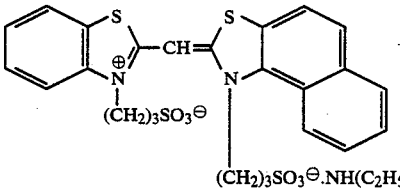
Samples 202–214 were prepared in just the same manner as in Sample 201 using Emulsion B prepared just the same manner as in Example 1 and the compounds indicated in Table 2, but adding them to the indicated layers in Table 2.
These Samples were subjected to the same treatment as in Example 1. The results are shown in Table 2.

TABLE 2

| Sample No. | Compound Added (amount: $1 \times 10^{-5}$ mol/m$^2$) | Layer Having the Compound Added Thereto | Layer Having the Internally Fogged Emulsion Added Thereto (amount: 0.05 g/m$^2$) | $\Delta S_{1.2}$ at the Cyan Density | $\Delta S_{0.4}$ at the Cyan Density | ($\Delta S_{0.4}$-$\Delta S_{1.2}$) at the Cyan Density | $\Delta S_{1.2}$ at the Magenta Density | $\Delta S_{0.4}$ at the Magenta Density | ($\Delta S_{0.4}$-$\Delta S_{1.2}$) at the Magenta Density | $\Delta S_{1.2}$ at the Yellow Density | $\Delta S_{0.4}$ at the Yellow Density | ($\Delta S_{0.4}$-$\Delta S_{1.2}$) at the Yellow Density | $\Delta D_{max}$ at the Cyan Density | $\Delta D_{max}$ at the Magenta Density | $\Delta D_{max}$ at the Yellow Density |
|---|---|---|---|---|---|---|---|---|---|---|---|---|---|---|---|
| 201 (Comparison) | — | — | — | 0.41 | 0.65 | 0.24 | 0.35 | 0.57 | 0.22 | 0.45 | 0.70 | 0.25 | 0.20 | 0.19 | 0.26 |
| 202 (Comparison) | (II-45) | 1st layer | — | 0.40 | 0.60 | 0.20 | 0.35 | 0.52 | 0.17 | 0.45 | 0.66 | 0.21 | 0.15 | 0.14 | 0. |
| 203 (Comparison) | Compound A | " | — | 0.41 | 0.65 | 0.24 | 0.34 | 0.57 | 0.23 | 0.45 | 0.70 | 0.25 | 0.20 | 0.20 | 0.26 |
| 204 (Comparison) | — | — | 3rd, 6th and 10th layers | 0.63 | 0.70 | 0.07 | 0.62 | 0.69 | 0.07 | 0.64 | 0.70 | 0.06 | 0.38 | 0.35 | 0.48 |
| 205 (Comparison) | — | — | 2nd, 5th and 9th layers | 0.60 | 0.68 | 0.08 | 0.60 | 0.67 | 0.07 | 0.62 | 0.69 | 0.07 | 0.33 | 0.33 | 0.45 |
| 206 (Comparison) | — | — | 4th, 7th and 11th layers | 0.62 | 0.70 | 0.08 | 0.62 | 0.68 | 0.06 | 0.63 | 0.69 | 0.06 | 0.39 | 0.35 | 0.49 |
| 207 (Comparison) | — | — | 5th, 8th and 12th layers | 0.62 | 0.70 | 0.08 | 0.63 | 0.69 | 0.06 | 0.64 | 0.70 | 0.06 | 0.42 | 0.40 | 0.49 |
| 208 (Comparison) | Compound A | 1st layer | 3rd, 6th and 10th layers | 0.63 | 0.69 | 0.06 | 0.62 | 0.70 | 0.08 | 0.63 | 0.71 | 0.08 | 0.35 | 0.35 | 0. |
| 209 (Invention) | (II-45) | " | 3rd, 6th and 10th layers | 0.63 | 0.66 | 0.03 | 0.62 | 0.65 | 0.03 | 0.64 | 0.68 | 0.04 | 0.20 | 0.18 | 0.25 |
| 210 (Invention) | " | " | 2nd, 5th and 9th layers | 0.60 | 0.63 | 0.03 | 0.60 | 0.63 | 0.03 | 0.62 | 0.66 | 0.04 | 0.19 | 0.18 | 0.24 |
| 211 (Invention) | (II-45) | 1st layer | 4th, 7th and 11th layers | 0.62 | 0.65 | 0.03 | 0.62 | 0.65 | 0.03 | 0.63 | 0.67 | 0.04 | 0.22 | 0.20 | 0.26 |
| 212 (Invention) | " | " | 5th, 8th and 12th layers | 0.62 | 0.66 | 0.04 | 0.63 | 0.67 | 0.04 | 0.64 | 0.68 | 0.04 | 0.22 | 0.21 | 0.26 |
| 213 (Invention) | " | " | 4th, 6th and 10th layers | 0.62 | 0.65 | 0.03 | 0.62 | 0.65 | 0.03 | 0.64 | 0.68 | 0.04 | 0.20 | 0.18 | 0.25 |
| 214 (Invention) | " | 11th layer | " | 0.62 | 0.66 | 0.04 | 0.62 | 0.65 | 0.03 | 0.64 | 0.66 | 0.02 | 0.23 | 0.19 | 0.24 |

Compound A

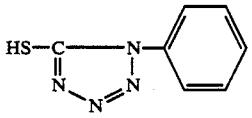

It is seen from Table 2 that since the photographic materials of the present invention have a larger extent of sensitization and less ($\Delta S_{0.4}-S_{1.2}$) than Comparative Examples 201 to 203, they have less variations in gradation due to the push development; also, the photographic materials of the present invention have a smaller extent of sensitization at D=0.4 than Comparative Examples 204 to 208, but have less variations in gradation due to push development and less variations in $D_{max}$.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide photographic emulsion layer and at least one layer containing colloidal silver, wherein said colloidal silver-containing layer comprises at least one compound selected from the group consisting of compounds of general formulae (I) and (II) below, and wherein at least one layer selected from a photosensitive silver halide emulsion layer farthest from the support and any other layer positioned between said photosensitive layer and said support comprises a silver halide emulsion containing internally-fogged or surface-fogged silver halide grains:

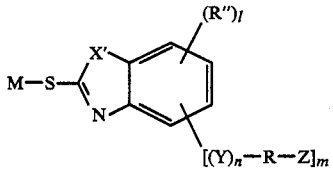

(I)

wherein

R represents a linear or branched alkylene group, a linear or branched alkenylene group, a linear or branched aralkylene group, or an arylene group;

Z represents a polar substituent,

Y represents

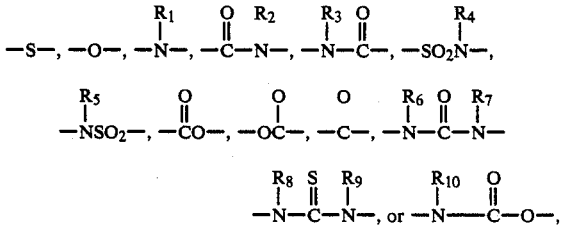

in which each of $R_1$, $R_2$, $R_3$ $R_4$, $R_5$, $R_6$, $R_7$, $R_8$, $R_9$ and $R_{10}$, which may be the same or different, represents a hydrogen atom or a substituted or unsubstituted alkyl group, substituted or unsubstituted aryl group, substituted or unsubstituted alkenyl group or substituted or unsubstituted aralkyl group;

X' represents

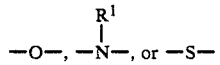

in which R' represents a hydrogen atom or a substituted or unsubstituted alkyl group or substituted or unsubstituted alkenyl group;

R'' represents a hydrogen atom or a group capable of replacing it;

M represents a hydrogen atom, an alkali metal atom, an ammoniumyl group or a group capable of being split off under alkaline conditions;

n represents 0 or 1;

m represents 0, 1 or 2, provided that m is not 0 when X' is —S— and l represents (4−m);

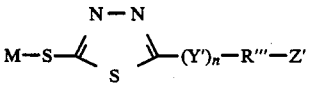

(II)

wherein R''' represents a linear or branched alkylene group, a linear or branched alkenylene group, a linear or branched aralkylene group or arylene group;

Z' represents a hydrogen atom or a polar substituents;

Y' represents

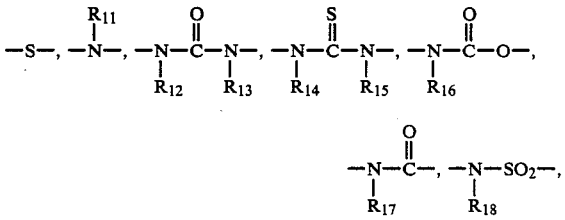

in which each of $R_{11}$, $R_{12}$, $R_{13}$, $R_{14}$, $R_{15}$, $R_{16}$, and $R_{18}$, which may be the same or different, represents a hydrogen atom, or a substituted or unsubstituted alkyl group, substituted or unsubstituted aryl group, substituted or unsubstituted alkenyl group, or substituted or unsubstituted aralkyl group; and n represents 0 or 1.

2. The photographic material of claim 1, wherein said colloidal silver-containing layer is an antihalation layer or a yellow filter layer.

3. The photographic material of claim 1, wherein in general formula (I), R represents a substituted or unsubstituted alkylene group; Y represents

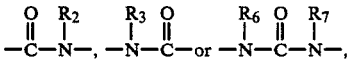

in which $R_2$, $R_3$, $R_6$ and $R_7$ are hydrogen atoms; X' is —NH— or —O—; and Z represents a substituted or unsubstituted amino group, a salt thereof or a heterocyclic group.

4. The photographic material of claim 1, wherein Z represents a polar substituent selected from the group consisting of a substituted or unsubstituted amino group, a quaternary ammonium group, an alkoxy group, an aryloxy group, an alkylthio group, an arylthio group, a heterocyclic oxy group, a heterocyclic thio group, a sulfonyl group, a carbamoyl group, a sulfamoyl group, a carbonamide group, a sulfonamide group, an acyloxy group, a ureido group, an acyl group, an aryloxycarbonyl group, a thioureido group, a sulfonyloxy group, a heterocyclic group, and a hydroxyl group.

5. The photographic material of claim 1, wherein said group capable of being split off under alkaline conditions is replaced by a hydrogen atom or an alkali metal.

6. The photographic material of claim 1, wherein said group capable of replacing said hydrogen atom in R'' is selected from the group consisting of a halogen atom, a substituted or unsubstituted alkyl group, a substituted or unsubstituted aryl group, a substituted or unsubstituted alkoxy group, a substituted or unsubstituted aryloxy group, a sulfonyl group, a sulfonamide group, a sulfamoyl group, a carbamoyl group, an amide group, a ureido group, an aryloxycarbonyl group, an alkoxycarbonyl group, an aryloxycarbonylamino group, an alkoxycarbonylamino group, and a cyano group.

7. The photographic material of claim 1, wherein said polar substituent represented by Z' is selected from the group consisting of a substituted or unsubstituted amino group, a quaternary ammonium group, an alkoxy group, an aryloxy group, an alkylthio group, an arylthio group, a heterocyclic oxy group, a heterocyclic thio group, a carbamoyl group, a sulfamoyl group, a carbonamide group, a sulfonamide group, an acyloxy group, a ureido group, an acyl group, an aryloxycarbonyl group, a thioureido group, a sulfonyloxy group, a heterocyclic group, and a cyano group, with the proviso that Z' does not represent a sulfonic acid group, a carboxylic acid group, a hydroxyl group, or an alkoxycarbonyl group.

8. The photographic material of claim 1, wherein said silver halide emulsion containing internally-fogged or surface-fogged silver halide grains is present in an amount of about 0.05 to about 50 mol% based on the photosensitive silver halide in the same layer or in an adjacent layer.

9. The photographic material of claim 8, wherein said amount is from 0.1 to 40 mol%.

10. The photographic material of claim 1, wherein said at least one compound of formulae (I) or (II) is present in an amount of from about 1 to about $10^{-5}$ mol per mol of silver halide in the same layer or an adjacent layer.

11. The photographic material of claim 9, wherein said amount is from $3\times10^{-1}$ to $3\times10^{-4}$ mol per mol of silver halide present in the same layer or an adjacent layer.

12. The photographic material of claim 1, wherein said silver halide emulsion containing internally-fogged or surface-fogged silver halide grains is present in a silver halide photosensitive layer positioned farthest from said support.

13. The photographic material of claim 1, wherein said silver halide grains are internally fogged.

14. The photographic material of claim 1, wherein at least one photosensitive layer comprises a silver halide emulsion containing internally-fogged or surface-fogged silver halide grains.

15. The photographic material of claim 2, wherein said colliidal silver-containing layer is an antihalation layer.

16. The photographic material of claim 1, wherein in general formula (I) X' represents —NH—.

* * * * *